US009891555B2

(12) United States Patent
Hara et al.

(10) Patent No.: US 9,891,555 B2
(45) Date of Patent: Feb. 13, 2018

(54) ELECTROSTATIC CHARGE IMAGE DEVELOPING TONER SET, ELECTROSTATIC CHARGE IMAGE DEVELOPER SET, AND TONER CARTRIDGE SET

(71) Applicant: FUJI XEROX CO., LTD., Tokyo (JP)

(72) Inventors: Satomi Hara, Kanagawa (JP); Masaru Takahashi, Kanagawa (JP); Atsushi Sugawara, Kanagawa (JP); Sakiko Hirai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/222,685

(22) Filed: Jul. 28, 2016

(65) Prior Publication Data

US 2017/0285518 A1 Oct. 5, 2017

(30) Foreign Application Priority Data

Mar. 29, 2016 (JP) ..... 2016-065727

(51) Int. Cl.

| | |
|---|---|
| ***G03G 9/09*** | (2006.01) |
| ***G03G 15/08*** | (2006.01) |
| ***G03G 9/08*** | (2006.01) |
| ***G03G 9/087*** | (2006.01) |

(52) U.S. Cl.
CPC ..... *G03G 15/0865* (2013.01); *G03G 9/0823* (2013.01); *G03G 9/08755* (2013.01); *G03G 9/0926* (2013.01)

(58) Field of Classification Search
CPC ..... G03G 9/09; G03G 9/0926
See application file for complete search history.

(56) References Cited

U.S. PATENT DOCUMENTS

2014/0023964 A1 1/2014 Hirai et al.

FOREIGN PATENT DOCUMENTS

JP 2014-021300 A 2/2014

*Primary Examiner* — Peter Vajda
(74) *Attorney, Agent, or Firm* — Oliff PLC

(57) ABSTRACT

An electrostatic charge image developing toner set includes a brilliant toner including toner particles that include a brilliant pigment and a first binder resin, a black toner including toner particles that include a second binder resin, and a color toner except a black toner, including toner particles that include a third binder resin, wherein the brilliant toner, the black toner and the color toner satisfy Expression (1): Dielectric loss factor of the brilliant Toner>Dielectric loss factor of the black toner>Dielectric loss factor of the color toner and Expression (2): $25\times10^{-3}\leq$ (Dielectric loss factor of the brilliant toner)−(Dielectric loss factor of the color toner)$\leq95\times10^{-3}$.

9 Claims, 3 Drawing Sheets

ELECTROSTATIC CHARGE IMAGE DEVELOPING TONER SET, ELECTROSTATIC CHARGE IMAGE DEVELOPER SET, AND TONER CARTRIDGE SET

CROSS-REFERENCE TO RELATED APPLICATIONS

This application is based on and claims priority under 35 USC 119 from Japanese Patent Application No. 2016-065727 filed Mar. 29, 2016.

BACKGROUND

1. Technical Field

The present invention relates to an electrostatic charge image developing toner set, an electrostatic charge image developer set, and a toner cartridge set.

2. Related Art

In order to form an electrophotographic image, in general, colors of the image are reproduced using toners of four colors including yellow, magenta, cyan, and black. In addition, in order to form an image having metallic gloss, a brilliant toner is used.

SUMMARY

According to an aspect of the invention, there is provided an electrostatic charge image developing toner set including:

a brilliant toner including toner particles that include a brilliant pigment and a first binder resin;

a black toner including toner particles that include a second binder resin; and a color toner except a black toner, including toner particles that include a third binder resin, wherein the brilliant toner, the black toner, and the color toner satisfy the following expressions (1) and (2):

Dielectric loss factor of the brilliant toner>Dielectric loss factor of the black toner>Dielectric loss factor of the color toner — Expression (1), and $25\times10^{-3}\leq$(Dielectric loss factor of the brilliant toner)−(Dielectric loss factor of the color toner)$\leq95\times10^{-3}$ — Expression (2).

BRIEF DESCRIPTION OF THE DRAWINGS

Exemplary embodiments of the present invention will be described in detail based on the following figures, wherein.

DETAILED DESCRIPTION

Figure 1:
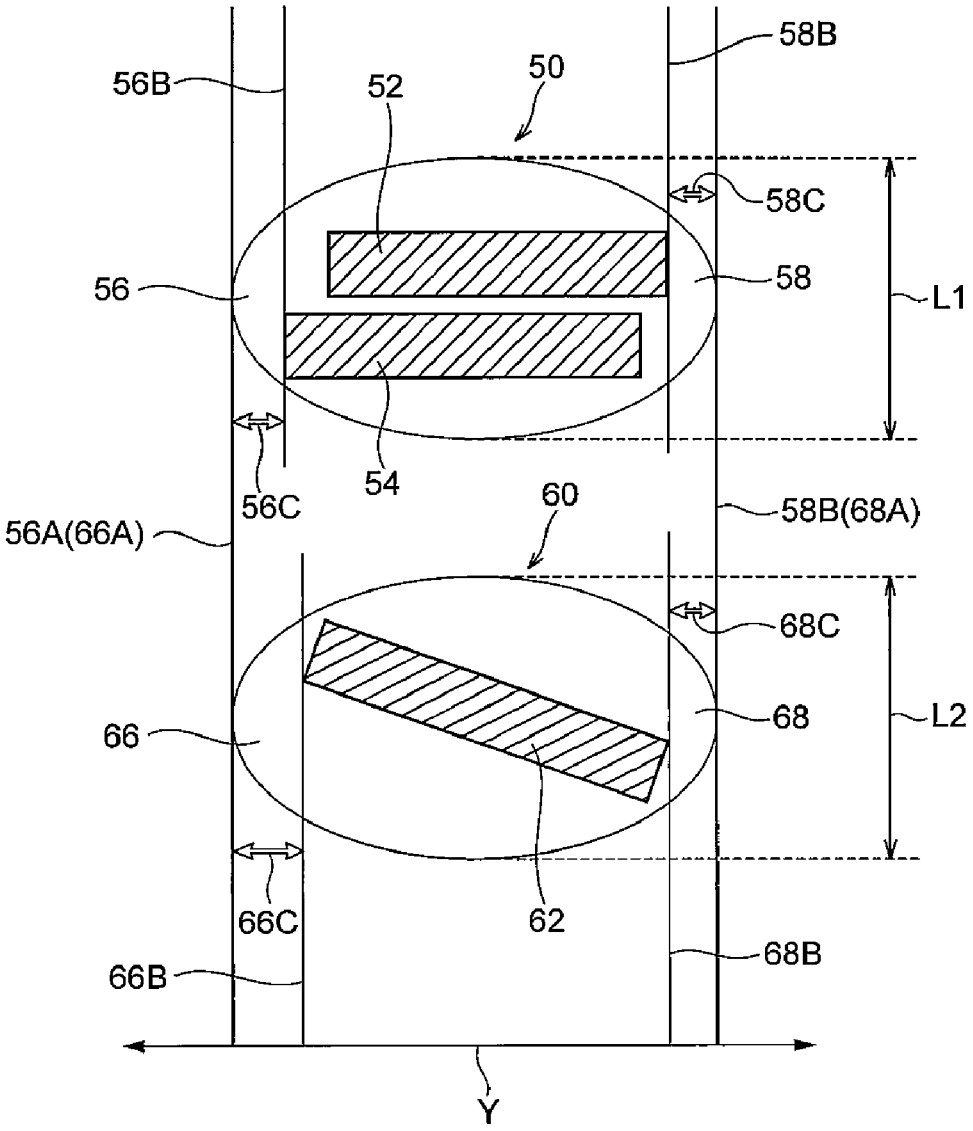
FIG. 1 is a diagram showing a method of obtaining a distance between a tangent line A of a brilliant toner particle and a tangent line B of a brilliant pigment.

Hereinafter, an exemplary embodiment which is an example of the invention will be described.

Electrostatic Charge Image Developing Toner Set

An electrostatic charge image developing toner set (hereinafter, referred to simply as "toner set") according to an exemplary embodiment of the invention includes: a brilliant toner including toner particles that include a brilliant pigment and a first binder resin; a black toner including toner particles that include a second binder resin; and a color toner other than black including toner particles that include a third binder resin.

The brilliant toner, the black toner, and the color toner satisfy the following conditional expressions (1) and (2). In this case, in a case where the toner set according to the exemplary embodiment includes plural color toners (for example, a yellow toner, a magenta toner, and a cyan toner), "Dielectric Loss Factor of Color Toner" in the following conditional expression (2) represents a lowest dielectric loss factor among dielectric loss factors of the color toners.

Dielectric loss factor of brilliant toner>Dielectric loss factor of black toner>Dielectric loss factor of color toner — Conditional Expression (1):

$25\times10^{-3}\leq$(Dielectric loss factor of brilliant toner)−(Dielectric loss factor of color toner)$\leq95\times10^{-3}$ — Conditional Expression (2):

In the related art, a toner set including a brilliant toner, a black toner, and a color toner other than black (for example, a yellow toner, a magenta toner, or a cyan toner) is known.

In an image forming apparatus on which the toner set is mounted, in many cases, images are continuously printed using only the black toner and the color toner without using the brilliant toner. In this case, the operation of a developing unit (an example of the developing unit) containing the brilliant toner is prevented, whereas developers of developing units containing the black toner and the color toner are repeatedly agitated. Therefore, a load is more likely to be applied to the black toner and the color toner than to the brilliant toner over time. As a result, exposure of a colorant and embedding of an external additive are likely to occur, and thus a dielectric loss factor is likely to increase. Accordingly, due to the above-described load, the brilliant toner, the black toner, and the color toner are likely to vary in electrical characteristics over time.

Here, dielectric loss refers to a phenomenon in which, when an alternating electric field is applied to a dielectric (corresponding to the brilliant toner, the black toner, and the color toner in the exemplary embodiment), electric energy in the dielectric is converted into thermal energy and lost. The dielectric loss factor refers to a loss factor of the electric energy.

Specifically, it is presumed that, when an image is formed using the brilliant toner in a state where the dielectric loss factors of the black toner and the color toner are increased over time, differences between the dielectric loss factors (differences between the electric characteristics) of the respective toners cause the following phenomenon.

Typically, in an image forming apparatus, when toner images are transferred (multiple transfer or collective transfer), a transfer electric field is adjusted such that an optimum transfer efficiency is obtained. Specifically, during the adjustment, a higher transfer electric field than an initial transfer electric field may be applied to the black toner and the color toner whose dielectric loss factors are increased over time. When an image is formed in this transfer electric field using the brilliant toner having a lower dielectric loss factor than the black toner and the color toner, electric charge is injected into the brilliant toner during transfer. As a result, transfer unevenness is likely to be caused, and density unevenness is likely to be caused in the obtained image.

On the other hand, in the toner set according to the exemplary embodiment, the dielectric loss factors of the brilliant toner, the black toner, and the color toner are adjusted in advance such that the toners satisfy the conditional expressions (1) and (2).

The conditional expression (1) represents that the dielectric loss factors of the toners are high in order of the brilliant toner, the black toner, and the color toner. In the conditional expression (1), considering the fact that the dielectric loss factors of the black toner and the color toner are likely to increase over time, the dielectric loss factors of the black toner and the color toner are adjusted to be lower than the dielectric loss factor of the brilliant toner in advance.

On the other hand, originally, the black toner has a characteristic in which the dielectric loss factor is likely to higher than that of the color toner.

Therefore, in the toner set according to the exemplary embodiment, a difference between an initial dielectric loss factor of the brilliant toner and an initial dielectric loss factor of the color toner is adjusted to the above-described range, that is, satisfies the conditional expression (2), and further satisfies the conditional expression (1). As a result, in a case where the dielectric loss factors of the black toner and the color toner are increased over time, the difference between the dielectric loss factors of the toners is adjusted to a specific range. Thus, when toner images are transferred (multiple transfer or collective transfer), a transfer electric field applied to each of the toners approaches the optimum state, and each of the toner images is likely to be transferred with a substantially optimum transfer efficiency. That is, even when an image is formed using the brilliant toner after continuously forming images only using the black toner and the color toner, electric charge is not likely to be injected into the brilliant toner during transfer, and occurrence of transfer unevenness of the toner images is prevented. As a result, density unevenness is not likely to be caused in the obtained image.

Therefore, in the toner set according to the exemplary embodiment, density unevenness, which is caused when an image is formed using a brilliant toner after continuously forming images only using a black toner and a color toner, is prevented, and a high-quality image is likely to be obtained over time.

The transfer unevenness and the density unevenness are likely to be caused considerably in a high-temperature and high-humidity environment and in a low-temperature and low-humidity environment. However, in the toner set according to the exemplary embodiment, even in the above-described environment, the occurrence of transfer unevenness and density unevenness is prevented, and a high-quality image is likely to be obtained over time.

In the conditional expression (2) according to the exemplary embodiment, from the viewpoint of further exhibiting the effects of the toner set according to the exemplary embodiment, it is preferable that the following conditional expression (22) is satisfied, and it is more preferable that the conditional expression (23) is satisfied.

$$35\times10^{-3}\leq(\text{Dielectric loss factor of brilliant toner})-(\text{Dielectric loss factor of color toner})\leq80\times10^{-3} \quad \text{Conditional Expression (22):}$$

$$40\times10^{-3}\leq(\text{Dielectric loss factor of brilliant toner})-(\text{Dielectric loss factor of color toner})\leq60\times10^{-3} \quad \text{Conditional Expression (23):}$$

The dielectric loss factors of the brilliant toner, the black toner, and the color toner (hereinafter, referred to as "toner") are measured as follows.

The toner is pressure-molded at 98067 kPa (1,000 Kgf/cm2) for 2 minutes so as to obtain a disk shape having a diameter of 50 mm and a thickness of 3 mm. The molded article is kept in an atmosphere having a temperature of 40° C. and a relative humidity of 50% for 17 hours and is further kept in an atmosphere having a temperature of 25° C. and a relative humidity of 55% for 24 hours.

Next, the toner is set in a solid battery (SE-71, manufactured by Ando Electric Co., Ltd.) having an electrode diameter of 38 mm, and the dielectric loss factor of the toner is measured using a dielectric measurement system (126096W, manufactured by AMTEK Inc.) under conditions of 1,000 Hz and 5.0 V.

In the toner set according to the exemplary embodiment, preferable examples of the brilliant toner satisfying the conditional expressions (1) and (2) include a brilliant toner whose toner particles (brilliant toner particles) are close to the brilliant pigment.

Specifically, when a projected image of each of the brilliant toner particles is observed, an average distance between a tangent line A of the toner particle and a tangent line B of the brilliant pigment at opposite end portions of the toner particle (hereinafter, also referred to as "inter-tangent line AB distance") is 30 nm or more and less than 1,000 nm (more preferably 100 nm or more and less than 800 nm, and still more preferably 300 nm or more and less than 500 nm), the tangent line A being perpendicular to a long axis direction of the toner particle, and the tangent line B being parallel to the tangent line A and closest to the tangent line A.

Here, "the long axis direction" refers to a direction of the longest axis.

By adjusting the inter-tangent line AB distance to the above-described range, the distance between the brilliant toner particles and the brilliant pigment is short. Therefore, the dielectric loss factor of the brilliant toner is likely to be improved and is likely to satisfy the conditional expressions (1) and (2). As a result, the effects of the toner set according to the exemplary embodiment is more likely to be exhibited.

Hereinafter, the inter-tangent line AB distance of the brilliant toner particles will be described using the drawings.

FIG. 1 is a diagram schematically showing a projected image of a brilliant toner particle.

A brilliant toner particle 50 is a flake shape toner particle having a thickness L1 and includes, for example, flake shape brilliant pigments 52 and 54. The brilliant pigments 52 and 54 are arranged along a long axis direction Y of the brilliant toner particle 50.

In addition, a brilliant toner particle 60 is a flake shape toner particle having a thickness L2 and includes, for example, a flake shape brilliant pigment 62. A long axis direction of the brilliant pigment 62 is tilted at an angle with respect to the long axis direction Y of the brilliant toner particle 60.

The inter-tangent line AB distance of the brilliant toner particle 50 is obtained as follows.

First, a distance 56C between a tangent line 56A and a tangent line 56B at one end 56 of the brilliant toner particle 50 in the long axis direction Y is obtained, the tangent line 56A which contacts with a surface of the brilliant toner particle 50 and perpendicular to the long axis direction Y, and the tangent line 56B (the tangent line of the brilliant pigment 54) which contacts with a surface of the brilliant pigment 52 or 54, parallel to the tangent line 56A, and closest to the tangent line 56A.

Likewise, a distance 58C between a tangent line 58A and a tangent line 58B at the other end 58 of the brilliant toner particle 50 in the long axis direction Y is obtained, the tangent line 58A which contacts with a surface of the brilliant toner particle 50 and perpendicular to the long axis direction Y, and the tangent line 56B (the tangent line of the brilliant pigment 52) which contacts with a surface of the brilliant pigment 52 or 54, parallel to the tangent line 58A, and closest to the tangent line 58A.

An average value of the distance 56C and the distance 58C is the inter-tangent line AB distance of the brilliant toner particle 50.

In the brilliant toner particle 60, similarly, an average value of a distance 66C between a tangent line 66A and a tangent line 66B at one end 66 of the brilliant toner particle 60 and a distance 68C between a tangent line 68A and a tangent line 68B at the other end 68 of the brilliant toner particle 60 is set as the inter-tangent line AB distance.

In addition, a method of actually measuring the inter-tangent line AB distance of the brilliant toner particles included in the brilliant toner is, for example, as follows.

Specifically, first, 0.1 parts of the brilliant toner, 4 parts of ion exchange water, and 0.01 parts of an anionic surfactant (NEOGEN R, manufactured by Daiichi Kogyo Seiyaku Co. Ltd.) are mixed with each other to prepare a dispersion. Next, using a flow particle image analyzer FPIA-3000 (manufactured by Sysmex Corporation), projected images of 4500 brilliant toner particles in the dispersion are observed. The inter-tangent line AB distance values of the individual brilliant toner particles are obtained, and the average value thereof is obtained as "the inter-tangent line AB distance of the brilliant toner particles included in the brilliant toner".

The light and shade of the projected images of the brilliant toner particles obtained by the observation vary depending on whether or not the brilliant pigment is present. Therefore, based on the brightness of the projected images, a region where the brilliant pigment is present (dark portion) and a region of a resin layer where the brilliant pigment is not present (bright portion) are distinguished from each other.

It is preferable that both of the distance between the tangent line A and the tangent line B at one end of the brilliant toner particle and the distance between the tangent line A and the tangent line B at the other end of the brilliant toner particle are in the above-described range.

In the brilliant toner according to the exemplary embodiment, examples of a method of adjusting the inter-tangent line AB distance to the above-described range include a method of controlling the inter-tangent line AB distance by changing the addition amounts and the number of times of addition of a binder resin and a coagulant in a toner preparation process of an aggregating and coalescing method which is one of the toner preparation methods; and a method of controlling the inter-tangent line AB distance by controlling a stirring rate during the addition of the binder resin and the coagulant in the toner preparation process.

In addition, in the toner set according to the exemplary embodiment, in order to obtain the brilliant toner, the black toner, and the color toner satisfying the conditional expressions (1) and (2) as described above, it is preferable that each of the first to third binder resins of the brilliant toner, the black toner, and the color toner each independently include a crystalline polyester resin and that a carbon chain length of the crystalline polyester resin of the brilliant toner (hereinafter referred to as a first crystalline polyester resin) is longer than a carbon chain length of the crystalline polyester resin of the black toner (hereinafter referred to as a second crystalline polyester resin) and a carbon chain length of the crystalline polyester resin of the color toner (hereinafter referred to as a third crystalline polyester resin).

As a result, in a case where the content of the first crystalline polyester resin with respect to the toner particles of the brilliant toner is equal to the content of the second crystalline polyester resin with respect to the toner particles of the black toner and the content of the third crystalline polyester resin with respect to the toner particles of the color toner, an ester group concentration of the first crystalline polyester resin of the brilliant toner is lower than an ester group concentration of the second crystalline polyester resin and an ester group concentration of the third crystalline polyester resin. Therefore, along with a decrease in the ester group concentration of the brilliant toner, the polarizability of the brilliant toner is likely to decrease. As a result, the order of the dielectric loss factors are likely to satisfy both of the conditional expressions (1) and (2). Accordingly, the effects of the toner set according to the exemplary embodiment is more likely to be exhibited.

"The case where the content of the first crystalline polyester resin with respect to the toner particles of the brilliant toner is equal to the content of the second crystalline polyester resin with respect to the toner particles of the black toner and the content of the third crystalline polyester resin with respect to the toner particles of the color toner" means that a difference between the content of the first crystalline polyester resin and the content of the second crystalline polyester resin and a difference between the content of the first crystalline polyester resin and the content of the third crystalline polyester resin are, for example, 10% by weight or lower (preferably 5% by weight or lower).

It is preferable that a difference between the content of the first crystalline polyester resin with respect to the toner particles of the brilliant toner and the content of the second crystalline polyester resin with respect to the toner particles of the black toner is from 2 to 10 and a difference between the content of the first crystalline polyester resin toner with respect to the toner particles of the brilliant toner and the content of the third crystalline polyester resin with respect to the toner particles of the color toner is from 2 to 10.

As the crystalline polyester resin, for example, a crystalline polyester resin including a diol-derived constitutional unit and a dicarboxylic acid-derived constitutional unit.

Here, in the exemplary embodiment, "the carbon chain length of the crystalline polyester resin" refers to the sum of the carbon chain length of the diol component and the carbon chain length of the dicarboxylic acid component for each unit.

The carbon chain length of the diol component refers to the sum of the number of the first carbon atom to which one of two hydroxyl groups is bonded, the number of the second carbon atom to which the other one of the two hydroxyl groups is bonded, and the number of carbon atoms which are included as a component constituting a linear skeleton between the first carbon atom and the second carbon atom. For example, the carbon chain length of 1, 9-nonanediol is 9, and the carbon chain length of 1,6-hexanediol is 6. In a case where the linear skeleton has a branch and a substituent, the number of carbon atoms of the branch and the substituent is not included.

The carbon chain length of the dicarboxylic acid component refers to the sum of the number of first carbon atoms to which one of two carboxy groups is bonded, the number of second carbon atoms to which the other one of the two carboxy groups is bonded, and the number of carbon atoms which are included as a component constituting a linear skeleton between the first carbon atoms and the second carbon atoms. For example, the carbon chain length of dodecanedioic acid (1,10-decanedicarboxylic acid) is 10, and the carbon chain length of decanedioic acid (1,8-octanedicarboxylic acid, sebacic acid) is 8. That is, the carbon chain length of the dicarboxylic acid component does not include the number of carbon atoms in the carboxy groups. In a case where the linear skeleton has a branch and a substituent, the number of carbon atoms of the branch and the substituent is not included.

When an aromatic component is used as the diol component or the dicarboxylic acid component, the carbon chain length of the aromatic component refers to the carbon chain length on a side where the number of carbon atoms forming a main chain in a region up to a substitution site is small (for example, the carbon chain length of a para-substituted benzene ring is 4, and the carbon chain length of a meta-substituted benzene ring is 3).

Here, in a case where the brilliant toner includes, for example, an aliphatic crystalline polyester resin as the binder resin, the carbon chain length of the crystalline polyester resin is preferably from 12 to 24, more preferably from 16 to 22, and still more preferably from 16 to 19 from the viewpoint of obtaining the brilliant toner satisfying the conditional expressions (1) and (2).

Here, in a case where the black toner includes, for example, an aliphatic crystalline polyester resin as the binder resin, the carbon chain length of the crystalline polyester resin is preferably from 10 to 22, more preferably from 12 to 19, and still more preferably from 14 to 17 from the viewpoint of obtaining the black toner satisfying the conditional expressions (1) and (2).

Here, in a case where the color toner includes, for example, an aliphatic crystalline polyester resin as the binder resin, the carbon chain length of the crystalline polyester resin is preferably from 10 to 22, more preferably from 12 to 19, and still more preferably from 14 to 17 from the viewpoint of obtaining the color toner satisfying the conditional expressions (1) and (2).

In addition, a difference between the carbon chain length of the first crystalline polyester resin and the shortest one of the carbon chain lengths of the second and third crystalline polyester resins is preferably 1 to 8, more preferably 2 to 6, and still more preferably 3 to 5 from the viewpoint of further exhibiting the effects of the toner set according to the exemplary embodiment.

It is preferable that a difference between the carbon chain length of the first crystalline polyester resin and the carbon chain length of the second crystalline polyester resin is from 1 to 8, more preferably from 2 to 6 and a difference between the carbon chain length of the first crystalline polyester resin and the carbon chain length of the third crystalline polyester resin is from 1 to 8, more preferably from 2 to 6.

Examples of a method of adjusting the carbon chain length of the crystalline polyester resin of each toner include a method of synthesizing a crystalline polyester resin after adjusting the number of carbon atoms in raw material monomers (for example, the diol component or the dicarboxylic acid component) constituting the crystalline polyester resin in advance.

The carbon chain length of the crystalline polyester resin of each toner is measured (calculated) using the following method.

First, using a well-known solvent separation method (for example, a Soxhlet method or an emulsion flow method), a colorant (a brilliant pigment, a black colorant, or a color colorant) are separated from the toner. In a case where the toner includes a release agent, the release agent is also separated from the toner. In a case where the toner includes an external additive, the external additive may be separated from the toner before performing the solvent separation method.

Next, using a difference in solubility between the respective materials, the crystalline polyester resin is further separated from the toner. A structure of the crystalline polyester resin separated from the toner is specified by $^{1}$H-NMR magnetic resonance). Specifically, peaks derived from protons (hereinafter, referred to as "protone peaks") bonded to an ester bond are detected, and each of the detected protone peaks is assigned, thereby specifying the structure of the crystalline polyester resin.

The carbon chain length of the crystalline polyester resin may be calculated from an integral ratio of the protone peaks. Measurement conditions of $^{1}$H-NMR are as follows.

Measurement Conditions

- Measurement device: a nuclear magnetic resonance device (AL-400 (magnetic field: 9.4 T (H-nucleus: 400 MHz)), manufactured by JEOL Ltd.)
- Vessel: φ 5 mm glass tube
- Solvent: a heavy chloroform solution
- Measurement temperature: 25° C.
- Observed nucleus: $^{1}$H
- Cumulative number: 64
- Reference material: tetramethylsilane (TMS; TMS concentration in a solvent: 0.05 vol %)
- Sample concentration: 30 mg of a sample is dissolved in 0.7 mL of the heavy chloroform solution In a case where it is difficult to calculate the carbon chain length of the crystalline polyester resin in the measurement of $^{1}$H-NMR, in addition to the measurement results of $^{1}$H-NMR, the measurement results of $^{13}$C-NMR ($^{13}$C-nuclear magnetic resonance; Model No.: ADVANCED III HD Sample Express 600 MHz NMR, manufactured by Bruker Corporation), infrared absorption spectrum (IR), and gas chromatography-mass spectrometry (GC-MS) are optionally used.

In addition, in the toner set according to the exemplary embodiment, in order to obtain the brilliant toner, the black toner, and the color toner which satisfy the above-described conditional expressions (1) and (2), it is preferable that the binder resins of the brilliant toner, the black toner, and the color toner each independently include a crystalline polyester resin (namely, a first to third crystalline polyester resins, respectively) and that the content of the first crystalline polyester resin with respect to the toner particles of the brilliant toner is lower than the content of the second crystalline polyester resin with respect to the toner particles of the black toner and is lower than the content of the third crystalline polyester resin with respect to the toner particles of the color toner.

As a result, for example, in a case where the carbon chain lengths of the first to third crystalline polyester resins of the brilliant toner, the black toner, and the color toner are substantially the same as each other, the ester group concentration of the first crystalline polyester resin is lower than the ester group concentrations of the second and third crystalline polyester resins. Therefore, the polarizability of the brilliant toner is likely to decrease. As a result, the order of the dielectric loss factors are likely to satisfy both of the conditional expressions (1) and (2) without a remarkable difference between the dielectric loss factors of the black toner and the color toner. Accordingly, the effects of the toner set according to the exemplary embodiment is more likely to be exhibited.

"The case where the carbon chain lengths of the first to third crystalline polyester resins of the brilliant toner, the black toner, and the color toner are substantially the same as each other" means that a difference between the longest carbon chain length and the shortest carbon chain length among the carbon chain lengths of the first to third crystalline polyester resins is, for example, 5 or less (preferably, 3 or less).

In order to make the carbon chain lengths of the crystalline polyester resins of the toners substantially the same, for example, in a case where the toners are prepared using an aggregating and coalescing method, the toners (toner particles) may be prepared using the same crystalline resin particle dispersion.

Hereinafter, the brilliant toner included in the toner set according to the exemplary embodiment will be described.

In the exemplary embodiment, "brilliance" refers to metallic gloss of an image formed using the brilliant toner according to the exemplary embodiment when visually recognized.

For example, when a solid image which is formed using the brilliant toner is irradiated with light at an incident angle of −45° using a goniophotometer, a ratio (A/B) of a reflectance A at a light-receiving angle of +30° to a reflectance B at a light-receiving angle of −30° is from 2 to 100.

The ratio (A/B) being 2 or higher means that the amount of light reflected from an side (positive angle side) opposite to the light incident side is more than that reflected from the light incident side (negative angle side), that is, the diffused reflection of the incident light is prevented. In a case where diffused reflection occurs, that is, incident light is reflected in various directions, the reflected light appears dull when visually recognized. Therefore, in a case where the ratio (A/B) is 2 or higher, when reflected is visually recognized, gloss is recognized, and thus brilliance is satisfactory.

On the other hand, in a case where the ratio (A/B) is 100 or lower, a viewing angle at which reflected light is visually recognized is excessively narrow. Therefore, a phenomenon in which the reflected light appears black depending on angles is not likely to occur.

The ratio (A/B) is more preferably from 20 to 90 and still more preferably from 40 to 80.

Measurement of Ratio (A/B) Using Goniophotometer

Here, first, an incident angle and a light-receiving angle will be described. In the exemplary embodiment, the incident angle is set as −45° during the measurement using the goniophotometer, and the reason for this is that, with this configuration, the measurement sensitivity is high for an image having a wide range of glossiness.

In addition, the reason why the light-receiving angles are set as −30° and +30° is that, with this configuration, the measurement sensitivity is highest for evaluating an image having glossiness and an image having no glossiness.

Next, a method of measuring the ratio (A/B) will be described.

In the exemplary embodiment, during the measurement of the ratio (A/B), first, "solid image" is formed using the following method. A developing unit "DOCUCENTRE-III C7600" (manufactured by Fuji Xerox Co., Ltd.) is filled with a developer as a sample, and a solid image having a toner applied amount of 4.5 g/m$^2$ is formed on a recording sheet (OK TOPCOAT+, manufactured by Oji Paper Co., Ltd.: glossiness 75, whiteness 85.0) at a fixing temperature of 190° C. and a fixing pressure of 4.0 kg/cm2.

"The solid image" refers to an image having a coverage rate of 100%.

By using a variable angle spectrophotometer GC5000L (manufactured by Nippon Denshoku Industries Co., Ltd.) as a goniophotometer, incident light is incident on an image portion of the formed solid image at an incident angle of −45° with respect to the solid image, and the reflectance A at a light-receiving angle of +30° and the reflectance B at a light-receiving angle of −30° are measured. Each of the reflectance A and the reflectance B is an average value of reflectances of light in a wavelength range of 400 nm to 700 nm which are measured at an interval of 20 nm. Based on the measurement results, the ratio (A/B) is calculated.

Configuration of Brilliant Toner

From the viewpoint of satisfying the ratio (A/B), it is preferable that the brilliant toner according to the exemplary embodiment includes brilliant toner particle satisfying the following requirements (a) and (b). (a) An average equivalent circle diameter D of the brilliant toner particles is longer than an average maximum thickness C of the brilliant toner particles. (b) In a case where cross-sections of the brilliant toner particles in a thickness direction are observed, brilliant pigment particles whose long axis direction has an angle of −30° to +30° with respect to a long axis direction of the cross-sections of the brilliant toner particles account for 60% or higher of all the observed brilliant pigment particles.

FIG. 1 shows an example of the brilliant toner particles satisfying the requirements (a) and (b) and is a cross-sectional view of the brilliant toner particles in the thickness direction.

When the brilliant toner particles 50 and 60 are flake shape as shown in FIG. 1, it is presumed that, in a fixing process of forming an image, the flake shape brilliant toner particles are arranged due to a fixing pressure such that flake shape surfaces thereof face a surface of a recording medium. That is, it is presumed that, on a recording medium to which the brilliant toner particles are finally transferred, the flake shape brilliant toner particles are arranged such that flake shape surfaces thereof face a surface of the recording medium. In addition, it is presumed that, in a fixing process of forming an image, the flake shape brilliant toner particles are arranged due to a fixing pressure such that flake shape surfaces thereof face a surface of a recording medium.

Therefore, it is presumed that, among flake shape (flaky) brilliant toner particles included in the brilliant toner particles, brilliant pigment particles which satisfy the requirement (b) "a long axis direction thereof has an angle of −30° to +30° with respect to a long axis direction of the cross-sections of the brilliant toner particles" are arranged such that surfaces having the largest area face a surface of a recording medium. It is presumed that, in a case where a formed image is irradiated with light, the proportion of brilliant pigment particles in which diffused reflection occurs with respect to the incident light is reduced, and thus the range of the ratio (A/B) is achieved.

Hereinafter, components of the brilliant toner included in the toner set according to the exemplary embodiment will be described.

The brilliant toner includes toner particles (brilliant toner particles) and optionally further includes an external additive which is externally added to the brilliant toner particles.

For example, the brilliant toner particles include a brilliant pigment as a colorant and a binder resin and optionally further includes a release agent and other additives.

Brilliant Pigment

Examples of the brilliant pigment include a pigment (brilliant pigment) capable of imparting brilliance such as metallic gloss. The brilliant pigment is not particularly limited as long as it has brilliance, and examples thereof include powders of metals such as aluminum (elemental Al), brass, bronze, nickel, stainless steel, or zinc; micas coated with titanium oxide, yellow iron oxide, or the like; flaky inorganic crystal substrates coated with barium sulfate, layered silicate, layered aluminosilicate, or the like; single-crystal plate-shaped titanium oxides; basic carbonates; bismuth oxychlorides; natural guanines; flaky glass powders; and metal-deposited flaky glass powders.

Among these brilliant pigments, from the viewpoint of mirror reflection intensity, a metal powder is preferable, and aluminum powder is most preferable.

Here, the brilliant toner according to the exemplary embodiment may include brilliant toner particles including: a brilliant pigment and an organic pigment as colorants; and a binder resin.

Examples of the organic pigment include a color colorant described below.

That is, the toner set according to the exemplary embodiment may include: a brilliant toner including brilliant toner particles that include a brilliant pigment, an organic pigment, and a first binder resin; a black toner including black toner particles that include a second binder resin; and a color toner other than black including color toner particles that include a third binder resin.

In the above-described toner set, even when the brilliant toner further includes an organic pigment, density unevenness, which is caused when an image is formed using a brilliant toner after continuously forming images only using a black toner and a color toner, is likely to be prevented.

It is preferable that the shape of the brilliant pigment is flake shape (flaky). The shape of the brilliant pigment is not limited to a flake shape and, for example, may be spherical.

In a case where the shape of the brilliant pigment is flake shape, the average length of the brilliant pigment in the long axis direction is preferably from 1 μm to 30 μm, more preferably from 3 μm to 20 μm, and still more preferably from 5 μm to 15 μm.

A ratio (aspect ratio) of the average length of the brilliant pigment in the long axis direction to the average thickness of the brilliant pigment in the thickness direction, which is 1, is preferably from 5 to 200, more preferably from 10 to 100, and still more preferably from 30 to 70.

The average length and the aspect ratio of the brilliant pigment is measured using the following method. Using a scanning electron microscope (S-4800, manufactured by Hitachi High-Technologies Corporation), images of pigment particles are obtained at a desired measurement magnification (300 time to 100,000 times). In a state where the obtained images of the pigment particles are two-dimensionalized, the lengths of the particles in the long axis direction and the thicknesses of the particles in the thickness direction are measured, and the average length in the long axis direction and the aspect ratio of the brilliant pigment are calculated.

The content of the brilliant pigment is, for example, preferably from 1 part by weight to 50 parts by weight and more preferably from 15 parts by weight to 25 parts by weight with respect to 100 parts by weight of the brilliant toner particles.

In the following description of the binder resin, the release agent, other additives, and the external additive, "toner particles" refer to brilliant toner particles.

Binder Resin

Examples of the binder resin (including the first resin, the second resin and third resin) include vinyl resins made of a homopolymer of one monomer or copolymers of two or more monomers selected from the following monomers: styrenes (for example, styrene, parachlorostyrene, and α-methylstyrene); (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate); ethylenically unsaturated nitriles (for example, acrylonitrile and methacrylonitrile); vinyl ethers (for example, vinyl methyl ether and vinyl isobutyl ether); vinyl ketones (vinyl methyl ketone, vinyl ethyl ketone, and vinyl isopropenyl ketone); and olefins (for example, ethylene, propylene, and butadiene).

Examples of the binder resin include non-vinyl resins such as epoxy resins, polyester resins, polyurethane resins, polyamide resins, cellulose resins, polyether resins, and modified rosins; mixtures of the non-vinyl resins and the vinyl resins; and graft polymers obtained by polymerization of vinyl monomers in the presence of the non-vinyl resins.

Among these binder resins, one kind may be used alone, two or more kinds may be used in combination.

It is preferable that the binder resin according to the exemplary embodiment includes a crystalline resin.

The crystalline resin (including the first crystalline polyester resin, the second crystalline polyester resin and third crystalline polyester resin) is not particularly limited, and examples thereof include crystalline polyester resins, polyalkylene resins, and long-chain alkyl (meth)acrylate resins. Among these, a crystalline polyester resin is preferable from the viewpoint of exhibiting low-temperature fixing properties and the viewpoint that the dielectric loss factors of the brilliant toner, the black toner, and the color toner satisfy the conditional expressions (1) and (2).

Examples of the crystalline polyester resin include well-known polyester resins. It is preferable that the crystalline polyester resin is used in combination with an amorphous polyester resin.

In this case, the content of the crystalline polyester resin is from 2% by weight to 40% by weight (preferably, from 2% by weight to 20% by weight) with respect to the amount of the binder resin.

"Crystalline" of the resin means that the resin has not a step-wise change in endothermic energy amount but a clear endothermic peak in differential scanning calorimetry (DSC) and, specifically, means that the full width at half maximum of the endothermic peak is within 10° C. when measured at a temperature increase rate of 10 (° C./min).

On the other hand, "amorphous" of the resin means that the full width at half maximum exceed 10° C., that a step-wise change in endothermic energy amount is shown, or that a clear endothermic peak is not recognized.

Crystalline Polyester Resin

Examples of the crystalline polyester resin include a polycondensate of a polyvalent carboxylic acid and a polyol. As the crystalline polyester resin, a commercially available polyester resin or a synthetic polyester resin may be used.

Here, in order to easily form a crystal structure, it is preferable that crystalline polyester resin is a polycondensate obtained using a linear aliphatic polymerizable monomer rather than an aromatic polymerizable monomer.

Examples of the polyvalent carboxylic acid include aliphatic dicarboxylic acids (for example, oxalic acid, succinic acid, glutaric acid, adipic acid, suberic acid, azelaic acid, sebacic acid, 1,9-nonanedicarboxylic acid, 1,10-decanedicarboxylic acid, 1, 12-dodecanedicarboxylic acid, 1,14-tetradecanedicarboxylic acid, or 1,18-octadecanedicarboxylic acid), aromatic dicarboxylic acids (for example, dibasic acids such as phthalic acid, isophthalic acid, terephthalic acid, or naphthalene-2,6-dicarboxylic acid), and anhydrides or lower (for example, 1 to 5 carbon atoms) alkyl esters thereof.

As the polyvalent carboxylic acid, a dicarboxylic acid and a trivalent or higher valent carboxylic acid having a crosslinking structure or a branched structure may be used in combination. Examples of the trivalent carboxylic acid include aromatic dicarboxylic acids (for example, 1,2,3-benzenetricarboxylic acid, 1,2,4-benzenetricarboxylic acid, or 1,2,4-naphthalenetricarboxylic acid), and anhydrides or lower (for example, 1 to 5 carbon atoms) alkyl esters thereof.

As the polyvalent carboxylic acid, the dicarboxylic acid may be used in combination with a dicarboxylic acid having a sulfonic acid group or a dicarboxylic acid having an ethylenic double bond.

As the polyvalent carboxylic acid, one kind may be used alone, or two or more kinds may be used in combination.

Examples of the polyol include an aliphatic diol (for example, a linear aliphatic diol which includes a main chain having 7 to 20 carbon atoms). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, or 1,10-decanediol is preferable as the aliphatic diol.

As the polyol, a diol and a triol or higher polyol having a crosslinking structure or a branched structure may be used in combination. Examples of the trivalent or higher polyol include glycerin, trimethylolethane, trimethylolpropane, and pentaerythritol.

As the polyol, one kind may be used alone, or two or more kinds may be used in combination.

Here, the content of the aliphatic diol in the polyol is preferably 80% by mol or higher and more preferably 90% by mol or higher.

The melting temperature of the crystalline polyester resin is preferably from 50° C. to 100° C., more preferably from 55° C. to 90° C., and still more preferably from 60° C. to 85° C.

The melting temperature is calculated from the DSC curve obtained from differential scanning calorimetry (DSC) according to a "melting peak temperature" described in a method of calculating melting temperature in "Testing methods for transition temperatures of plastics" of JIS K7121-1987.

The weight average molecular weight (Mw) of the crystalline polyester resin is preferably from 6,000 to 35,000.

As in the case of the amorphous polyester resin, the crystalline polyester resin is obtained using a well-known polyester preparing method.

Amorphous Polyester Resin

Examples of the amorphous polyester resin include a polycondensate of a polyvalent carboxylic acid and a polyol. As the amorphous polyester resin, a commercially available amorphous polyester resin or a synthetic amorphous polyester resin may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, or sebacic acid), alicyclic dicarboxylic acids (for example, cyclohexanedicarboxylic acid), aromatic dicarboxylic acids (for example, terephthalic acid, isophthalic acid, phthalic acid, or naphthalenedicarboxylic acid), and anhydrides or lower (for example, from 1 to 5 carbon atoms) alkyl esters thereof. Among these, for example, an aromatic dicarboxylic acid is preferable as the polyvalent carboxylic acid.

As the polyvalent carboxylic acid, a dicarboxylic acid and a trivalent or higher valent carboxylic acid having a crosslinking structure or a branched structure may be used in combination. Examples of the trivalent or higher valent carboxylic acid include trimellitic acid, pyromellitic acid, and anhydrides or lower (for example, from 1 to 5 carbon atoms) alkyl esters thereof.

As the polyvalent carboxylic acid, one kind may be used alone, or two or more kinds may be used in combination.

Examples of the polyol include aliphatic diols (for example, ethylene glycol, diethylene glycol, triethylene glycol, propylene glycol, butanediol, hexanediol, or neopentyl glycol), alicyclic diols (for example, cyclohexanediol, cyclohexane dimethanol, or hydrogenated bisphenol A), and aromatic diols (for example, an ethylene oxide adduct of bisphenol A or a propylene oxide adduct of bisphenol A). Among these, as the polyol, for example, an aromatic diol or an alicyclic diol is preferable, and an aromatic diol is more preferable.

As the polyol, a diol and a triol or higher polyol having a crosslinking structure or a branched structure may be used in combination. Examples of the triol or higher polyol include glycerin, trimethylolpropane, and pentaerythritol.

As the polyol, one kind may be used alone, or two or more kinds may be used in combination.

The glass transition temperature of the amorphous polyester resin is preferably from 50° C. to 80° C. and more preferably from 50° C. to 65° C.

The glass transition temperature (Tg) is calculated from a DSC curve obtained from differential scanning calorimetry (DSC), more specifically, from "extrapolated glass transition starting temperature" described in a method of calculating a glass transition temperature in "Testing methods for transition temperatures of plastics" of JIS K 7121-1987.

The weight average molecular weight (Mw) of the amorphous polyester resin is preferably from 5,000 to 1,000,000, and more preferably from 7,000 to 500,000.

The number average molecular weight of the amorphous polyester resin is preferably from 2,000 to 100,000.

The molecular weight distribution Mw/Mn of the amorphous polyester resin is preferably from 1.5 to 100 and more preferably from 2 to 60.

The weight average molecular weight and the number average molecular weight are measured by gel permeation chromatography (GPC). In the measurement of the molecular weight by GPC, HLC-8120 GPC (manufactured by Tosoh Corporation) is used as a measuring device, and TSKgel SUPER HM-M (15 cm; manufactured by Tosoh Corporation) is used as a column, and THF is used as a solvent.

The weight average molecular weight and the number average molecular weight are calculated by using a molecular weight calibration curve obtained by a monodispersed polystyrene standard sample from the measurement result.

The amorphous polyester resin is obtained using a well-known preparing method. Specifically, the polyester resin is obtained, for example, using a method including: setting the polymerization temperature to be from 180° C. to 230° C.; optionally reducing the internal temperature of the reaction system; and causing a reaction to occur while removing water or an alcohol produced during condensation.

In a case where raw material monomers are not soluble or compatible at a reaction temperature, a high boiling point solvent as a solubilizer may be added to dissolve the monomers. In this case, the polycondensation reaction is performed while removing the solubilizer. In a case where a monomer having poor compatibility is present during a copolymerization reaction, the monomer having poor compatibility and an acid or an alcohol to be polycondensed with the monomer may be condensed first, and then the obtained condensate may be polycondensed with a major component.

The content of the binder resin is, for example, preferably from 40% by weight to 95% by weight, more preferably from 50% by weight to 90% by weight, and still more preferably from 60% by weight to 85% by weight with respect to the total amount of the toner particles.

Release Agent

Examples of the release agent include hydrocarbon waxes; natural waxes such as carnauba wax, rice wax, and candelilla wax; synthetic or mineral and petroleum waxes such as montan wax; and ester waxes such as fatty acid ester and montanic acid ester. The release agent is not limited to these examples.

The melting temperature of the release agent is preferably from 50° C. to 110° C. and more preferably from 60° C. to 100° C.

The melting temperature is calculated from the DSC curve obtained from differential scanning calorimetry (DSC) according to a "melting peak temperature" described in a method of calculating melting temperature in "Testing methods for transition temperatures of plastics" of JIS K 7121-1987.

The content of the release agent is, for example, preferably from 1% by weight to 20% by weight and more preferably from 5% by weight to 15% by weight with respect to the total amount of the toner particles.

Other Additives

Examples of the other additives include various additives such as a magnetic material, a charge-controlling agent, and inorganic powder. These additives are included in the toner particles as internal additives.

Properties of Brilliant Toner Particles

Average Maximum Thickness C and Average Equivalent Circle Diameter D

As shown in the requirement (a), in the exemplary embodiment, it is preferable that the average equivalent circle diameter D of the brilliant toner particles is longer than the average maximum thickness C of the brilliant toner particles. A ratio (C/D) of the average maximum thickness C to the average equivalent circle diameter D is preferably from 0.001 to 0.500, more preferably from 0.010 to 0.200, and still more preferably from 0.050 to 0.100.

By adjusting the ratio (C/D) to 0.001 or higher, the strength of the brilliant toner particles is secured, breakage caused by stress during the formation of an image is prevented, a decrease in charging characteristics caused by exposure of the pigment is prevented, and fogging caused by the decrease in charging characteristics is prevented. On the other hand, by adjusting the ratio (C/D) to 0.500 or lower, satisfactory brilliance is obtained.

The average maximum thickness C and the average equivalent circle diameter D are measured using the following method.

The brilliant toner particles are placed on a smooth surface and are uniformly dispersed by vibration. 1,000 brilliant toner particles are observed using a color laser microscope "VK-9700" (manufactured by Keyence Corporation) at a magnification of 1,000 times to measure the maximum thicknesses C and the equivalent circle diameters D when seen from the top, and the average values thereof are obtained.

Angle Between Long Axis Direction of Pigment Particles and Long Axis Direction of Cross-Sections of Brilliant Toner Particles As shown in (b), in a case where cross-sections of the brilliant toner particles in a thickness direction are observed, it is preferable that the number of pigment particles whose long axis direction has an angle of −30° to +30° with respect to a long axis direction of the cross-sections of the brilliant toner particles accounts for 60% or higher of the number of all the observed pigment particles. Further, the number of the pigment particles is more preferably from 70% to 95% and still more preferably from 80% to 90%.

By adjusting the number of the pigment particles to 60% or higher, satisfactory brilliance is obtained.

Here, a method of observing the cross-sections of the brilliant toner particles will be described.

The brilliant toner particles are embedded in a bisphenol A liquid epoxy resin and a curing agent to prepare a sample for cutting. Next, using a cutting machine with a diamond knife (in the exemplary embodiment, using LEICA ULTRAMICROTOME (manufactured by Hitachi High-Technologies Corporation)), the sample for cutting is cut at −100° C. to prepare a sample for observation. Using a transmission electron microscope (TEM), cross-sections of brilliant toner particles in this sample for observation are observed at a magnification of about 5,000 times. Regarding the observed 1,000 brilliant toner particles, the number of pigment particles whose long axis direction has an angle of −30° to +30° with respect to a long axis direction of the cross-sections of the brilliant toner particles is calculated using image analysis software, and the proportion thereof is calculated.

"The long axis direction of the cross-sections of the brilliant toner particles" refers to a direction perpendicular to the thickness direction of the brilliant toner particles in which the average equivalent circle diameter D is longer than the average maximum thickness C. In addition, "the long axis direction of the pigment particles" refers to a length direction of the pigment particles.

The brilliant toner particles may have a single-layer structure or a so-called core-shell structure including: a core (core particle) and a coating layer (shell layer) that coats the core.

Here, it is preferable that the brilliant toner particles having a core-shell structure include: a core that includes a binder resin and a brilliant pigment and optionally further includes other additives such as a colorant and a release agent; and a coating layer that includes a binder resin.

The volume average particle diameter of the brilliant toner particles in the exemplary embodiment is preferably from 1 μm to 30 μm and more preferably from 3 μm to 20 μm.

The volume average particle diameter D50v of the brilliant toner particles is obtained by drawing volume and number cumulative distributions on particle diameter ranges (channels), which are divided based on a particle diameter distribution measured using a measuring device such as COULTER MULTISIZER II (manufactured by Beckman Coulter Inc.), in order from the smallest particle diameter. Particle diameters having cumulative values of 16% by volume and number are defined as a volume average particle diameter $D_{16v}$ and a number average particle diameter $D_{16p}$, respectively. Particle diameters having cumulative values of 50% by volume and number are defined as a volume average particle diameter $D_{50v}$ and a number average particle diameter $D_{50p}$, respectively. Particle diameters having cumulative values of 84% by volume and number are defined as a volume average particle diameter $D_{84v}$ and a number average particle diameter $D_{84p}$, respectively. Using these values, a volume average particle diameter distribution index (GSDv) is calculated from $(D_{84v}/D_{16v})^{1/2}$.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as the external additive may be treated with a hydrophobizing agent. The hydrophobization treatment may be performed, for example, by dipping the inorganic particles in a hydrophobizing agent. The hydrophobizing agent is not particularly limited, and examples thereof include a silane coupling agent, silicone oil, a titanate coupling agent, and an aluminum coupling agent. Among these, one kind may be used alone, two or more kinds may be used in combination.

The amount of the hydrophobizing agent is from 1 part by weight to 10 parts by weight with respect to 100 parts by weight of the inorganic particles.

Examples of the external additive include resin particles (for example, resin particles of polystyrene, polymethyl methacrylate (PMMA), and melamine resin) and a cleaning aid (for example, particles of metal salts of higher fatty acids such as zinc stearate and fluorine polymers).

The content of the external additive is, for example, preferably from 0.01% by weight to 5% by weight and more preferably from 0.01% by weight to 2.0% by weight with respect to the total amount of the toner particles.

Next, components of the black toner and the color toner included in the toner set according to the exemplary embodiment will be described.

The black toner includes toner particles (black toner particles) and optionally further includes an external additive which is externally added to the toner particles.

The color toner includes toner particles (color toner particles) and optionally further includes an external additive which is externally added to the toner particles.

The configurations of the black toner and the color toner are not particularly limited as long as they are well-known toners of the related art including a colorant. Examples of the color toner include a magenta toner, a cyan toner, a yellow toner, a red toner, a green toner, a blue toner, an orange toner, and a violet toner.

In addition, examples of the external additive included in the black toner and the color toner are the same as the above-described examples of the external additive.

For example, the black toner particles include a black colorant as a colorant and a second binder resin and optionally further includes a release agent and other additives.

For example, the color toner particles include a color colorant other than black as a colorant and a third binder resin and optionally further includes a release agent and other additives.

Examples (including the contents thereof) of the binder resin, the release agent, and the other additives included in the black toner particles and the color toner particles are the same as the above-described examples of the binder resin, the release agent, and the other additives.

In the exemplary embodiment, as each of the components other than the colorant (that is, the binder resin and optionally the release agent and the other additives), the same material or different materials may be used in the brilliant toner, and the black toner, and the color toner.

Colorant

The colorant may be a dye or a pigment and, from the viewpoint of light fastness and water resistance, is preferably a pigment. As the colorant, one kind may be used alone, two or more kinds may be used in combination.

Examples of the colorant are as follows.

Examples of a yellow colorant include chrome yellow, zinc yellow, yellow iron oxide, cadmium yellow, Hansa Yellow, Hansa Yellow 10G, Benzidine Yellow G, Benzidine Yellow GR, Suren Yellow, Quinoline Yellow, and Permanent Yellow NCG.

Examples of a blue colorant include Prussian Blue, cobalt blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green, and Malachite Green Oxalate.

Examples of a red colorant include red iron oxide, cadmium red, red lead oxide, mercury sulfide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eoxine Red, and Alizarin Lake.

Examples of a green colorant include chromium oxide, chromium green, Pigment Green, Malachite Green Lake, and Final Yellow Green G.

Examples of an orange colorant include red chrome yellow, molybdenum orange, Permanent Orange GTR, Pyrazolone Orange, Vulkan Orange, Benzidine Orange G, Indanthrene Brilliant Orange RK, and Indanthrene Brilliant Orange GK.

Examples of a violet colorant include manganese violet, Fast Violet B, and Methyl Violet Lake.

Examples of a black colorant include carbon black, copper oxide, manganese dioxide, aniline black, activated carbon, non-magnetic ferrite, and magnetite.

The content of the colorant in each of the black toner and the color toner is preferably from 0.05% by weight to 12% by weight and more preferably from 0.5% by weight to 8% by weight with respect to the amount of the binder resin.

Characteristics and the Like of Black Toner Particles and Color Toner Particles

Hereinafter, characteristics and the like of the toner particles included in each of the black toner and the color toner according to the exemplary embodiment will be described. In the description common to the black toner particles and the color toner particles, the black toner particles and the color toner particles will be collectively referred to as "toner particles".

The toner particles may have a single-layer structure or a so-called core-shell structure including: a core (core particle) and a coating layer (shell layer) that coats the core.

Here, it is preferable that the brilliant toner particles having a core-shell structure include: a core that includes a binder resin and a colorant (a black colorant or a color colorant) and optionally further includes other additives such as a colorant and a release agent; and a coating layer that includes a binder resin.

The volume average particle diameter (D50v) of each of the black toner particles and the color toner particles is preferably from 2 μm to 10 μm and more preferably from 4 μm to 8 μm.

Various average particle diameters and various particle diameter distribution indices of the toner particles are measured by using COULTER MULTISIZER II (manufactured by Beckman Coulter Inc.) as a measuring device and using ISOTON-II (manufactured by Beckman Coulter Co., Ltd.) as an electrolytic solution.

During this measurement, from 0.5 mg to 50 mg of a measurement sample is added to 2 ml of an aqueous solution containing 5% of a surfactant (preferably, sodium alkylbenzene sulfonate) as a dispersant. This solution is added to from 100 ml to 150 ml of the electrolytic solution.

The electrolytic solution in which the measurement sample is suspended is dispersed with an ultrasonic disperser for 1 minute. Then, a particle diameter distribution of particles having a particle diameter in a range of from 2 μm to 60 μm is measured using COULTER MULTISIZER II and an aperture having an aperture size of 100 μm. The number of particles to be sampled is 50,000.

Using the measured particle distribution, volume and number cumulative particle diameter distributions are drawn on divided particle diameter ranges (channels) in order from the smallest particle diameter. In addition, particle diameters having cumulative values of 16% by volume and number are defined as a volume average particle diameter D16v and a number average particle diameter D16p, respectively. Particle diameters having cumulative values of 50% by volume and number are defined as a volume average particle diameter D50v and a number average particle diameter D50p, respectively. Particle diameters having cumulative values of 84% by volume and number are defined as a volume average particle diameter D84v and a number average particle diameter D84p, respectively.

Using these values, a volume average particle diameter distribution index (GSDv) is calculated from $(D84v/D16v)^{1/2}$, and a number average particle diameter distribution index (GSDp) is calculated from $(D84p/D16p)^{1/2}$.

The shape factor SF1 of each of the black toner particles and the color toner particles is preferably from 110 to 150 and more preferably from 120 to 140.

The shape factor SF1 is obtained from the following expression.

$$SF1=(ML^2/A)\times(\pi/4)\times 100 \quad \text{Expression:}$$

In the expression, ML represents an absolute maximum length of a toner particle, and A represents a projected area of a toner particle.

Specifically, the shape factor SF1 is converted to a numerical value by analyzing a microscopic image or a scanning electron microscope (SEM) image using an image analyzer and calculated as follows. That is, an optical microscope image of particles sprayed on a glass slide surface is input to an image analyzer LUZEX through a video camera, maximum lengths and projected areas of 100 particles are obtained to calculate shape factors thereof from the above expression, and an average value thereof is obtained.

Method of Preparing Toner

Hereinafter, a method of preparing the brilliant toner, the black toner, and the color toner according to the exemplary embodiment will be described. In the description common to the brilliant toner, the black toner, and the color toner, the brilliant toner, the black toner, and the color toner will be collectively referred to as "toner" and "toner particles". In addition, the brilliant pigment will be referred to as "colorant".

Examples of a method of increasing the dielectric loss factor of the black toner to be higher than that of the color toner so as to satisfy the conditional expression (1) include: a method of increasing the density of the black colorant; and a method of reducing the thickness of a shell layer of each of the toner particles, for example, in an emulsion aggregation method which is one of the toner preparation method.

In order to prepare the toner, after toner particles are prepared, the toner particles may be used as they are, or an external additive may be added to the toner particles.

The toner particles may be prepared using either a dry method (for example, a kneading and pulverizing method) or a wet method (for example, an aggregating and coalescing method, a suspension and polymerization method, or a melt and suspension method). The preparing method of the toner particles is not limited to these methods, and a well-known method is adopted. Among these, an aggregating and coalescing method is preferably used to obtain the toner particles.

Specifically, for example, in a case where toner particles are prepared using an aggregating and coalescing method, the toner particles are prepared through the following steps including:

a process (resin particle dispersion preparing process) of preparing a resin particle dispersion in which resin particles which form a binder resin are dispersed;

a process (colorant dispersion preparing process) of preparing a colorant dispersion in which a colorant is dispersed;

a process (aggregated particle forming process) of forming aggregated particles by aggregating the resin particles and the colorant in a dispersion in which the resin particle dispersion and the colorant dispersion are mixed with each other; and a process (coalescing process) of forming toner particles by heating an aggregated particle dispersion in which the aggregated particles are dispersed to coalesce the aggregated particles.

Hereinafter, each process will be described in detail. In the following description, a method of obtaining toner particles including a release agent will be described, but the release agent are optionally used. Additives other than the release agent may be used.

Resin Particle Dispersion Preparing Process

In the resin particle dispersion preparing process, a resin particle dispersion in which resin particles which form a binder resin are dispersed is prepared. The resin particle dispersion is prepared, for example, by dispersing resin particles in a dispersion medium using a surfactant.

Examples of the dispersion medium used in the resin particle dispersion include an aqueous medium.

Examples of the aqueous medium include water such as distilled water and ion exchange water; and alcohols. Among these, one kind may be used alone, or two or more kinds may be used in combination.

Examples of the surfactant include anionic surfactants such as sulfuric acid ester salts, sulfonic acid salts, phosphoric acid esters, and soaps; cationic surfactants such as amine salts and quaternary ammonium salts; and nonionic surfactants such as polyethylene glycol, alkylphenol ethylene oxide adducts, and polyols. Among these, an anionic surfactant or a cationic surfactant is preferably used. A nonionic surfactant may be used in combination with an anionic surfactant or a cationic surfactant.

As the surfactant, one kind may be used alone, or two or more kinds may be used in combination.

Examples of a method of dispersing resin particles in a dispersion medium to obtain the resin particle dispersion include general methods using a rotary shearing homogenizer or a dispersing machine having a medium such as a ball mill, a sand mill or a dyno mill. Depending on the kind of resin particles, for example, resin particles may be dispersed in the resin particle dispersion using an emulsion phase-inversion method.

In the emulsion phase-inversion method, a resin to be dispersed is dissolved in a hydrophobic organic solvent in which the resin is soluble, a base is added to an organic continuous phase (O phase) to neutralize the organic continuous phase, and then water (W phase) is poured thereinto. As a result, the phase of the resin is inverted from W/O to O/W (so-called phase inversion) so as to be a discontinuous phase, and the resin is dispersed in an aqueous medium in a particle form.

The volume average particle diameter of the resin particles dispersed in the resin particle dispersion is, for example, preferably from 0.01 μm to 1 μm, more preferably from 0.08 μm to 0.8 μm, and still more preferably from 0.1 μm to 0.6 μm.

In order to obtain the volume average particle diameter of the resin particles, using a particle diameter distribution which is obtained from measurement of a laser diffraction particle diameter distribution analyzer (for example, LA-700 manufactured by Horiba Ltd.), a volume cumulative distribution is drawn on divided particle diameter ranges (channels) in order from the smallest particle diameter. A particle diameter having a cumulative volume of 50% with respect to all the particles is defined as the volume average particle diameter D50v. The volume average particle diameter of other particles in other dispersions are measured using the same method as above.

The content of the resin particles in the resin particle dispersion is preferably from 5% by weight to 50% by weight and more preferably from 10% by weight to 40% by weight.

Using the same method as the method of preparing the resin particle dispersion, the colorant dispersion and the release agent dispersion are prepared. That is, the dispersion medium, the surfactant, the dispersing method, the volume average particle diameter of the particles, and the content of the particles in the colorant dispersion and the release agent dispersion are the same as those in the resin particle dispersion.

Aggregated Particle Forming Process

In a case where toner particles are prepared, aggregated particles including the resin particles and the colorant are formed by mixing the resin particle dispersion and the colorant dispersion with each other to obtain a mixed dispersion and hetero-aggregating the resin particles and the colorant the mixed dispersion. By adding a release agent dispersion, a release agent may be added to the aggregated particles.

Specifically, for example, a coagulant is added to the mixed dispersion, the pH of the mixed dispersion is adjusted to be acidic (for example, to be within a range from 2 to 5), and optionally a dispersion stabilizer is added. Next, the mixed dispersion is heated to a temperature near the glass transition temperature of the resin particle (specifically, from "(the glass transition temperature of the resin particle) −30° C." to "(the glass transition temperature of the resin particle) −10° C.") to aggregate the particles dispersed in the mixed dispersion. As a result, aggregated particles are formed.

In the aggregated particle forming process, for example, the mixed dispersion may be heated after adding a coagulant at room temperature (for example, 25° C.) while stirring the mixed dispersion using a rotary shearing homogenizer, adjusting the pH of the mixed dispersion to be acidic (for example, to be within a range from 2 to 5), and optionally adding a dispersion stabilizer.

As the coagulant, a surfactant having a polarity opposite to that of a surfactant included in the mixed dispersion is used, and examples thereof include an inorganic metal salt and a divalent or higher metal complex. In a case where a metal complex is used as the coagulant, the amount of the surfactant used is reduced, and charging characteristics are improved.

The coagulant may be used in combination with an additive for forming a complex or a similar bond with metal ions of the coagulant. As this additive, a chelating agent is preferably used.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfate.

As the chelating agent, a water-soluble chelating agent may be used. Examples of the chelating agent include oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The amount of the chelating agent added is, for example, preferably from 0.01 part by weight to 5.0 parts by weight and more preferably 0.1 part by weight or more and less than 3.0 parts by weight with respect to 100 parts by weight of the resin particles.

Coalescing Process

Next, the aggregated particle dispersion in which the aggregated particles are dispersed is heated to the glass transition temperature of the resin particle or higher (specifically, a temperature which is higher than the glass transition temperature of the resin particle by 10° C. to 30° C.) to coalesce the aggregated particle. As a result, toner particles are formed.

Through the above-described processes, the toner particles are obtained.

Toner particles may be prepared through the following processes including: a process of forming second aggregated particles by obtaining an aggregated particle dispersion in which aggregated particles are dispersed, and then further mixing the aggregated particle dispersion with a resin particle dispersion in which resin particles are dispersed so as to attach the resin particles to surfaces of the aggregated particles; and a process of forming toner particles having a core-shell structure by heating a second aggregated particle dispersion in which the second aggregated particles are dispersed to cause the second aggregated particles to coalesce.

After the coalescing process ends, toner particles formed in the solution are subjected to well-known processes including a washing process, a solid-liquid separation process, and a drying process. As a result, dry toner particles are obtained.

In the washing process, it is preferable that displacement washing using ion exchange water is sufficiently performed from the viewpoint of charging characteristics. In addition, in the solid-liquid separation process, although there is no particular limitation, it is preferable that suction filtration, pressure filtration, or the like is performed from the viewpoint of productivity. In addition, in the drying process, although there is no particular limitation, it is preferable that freeze drying, flash jet drying, fluidized drying, vibration-type fluidized drying, or the like is performed from the viewpoint of productivity.

The toner according to the exemplary embodiment is prepared, for example, by adding the external additive to the dry toner particles and mixing them with each other. It is preferable that the mixing is performed using a V blender, a HENSCHEL mixer, or a LODIGE mixer. Further optionally, coarse particles of the toner may be removed, for example, using a vibration classifier or a wind classifier.

Electrostatic Charge Image Developer Set

An electrostatic charge image developer set according to the exemplary embodiment includes: a first electrostatic charge image developer that includes the brilliant toner of the toner set according to the exemplary embodiment; a second electrostatic charge image developer that includes the black toner of the toner set according to the exemplary embodiment; and a third electrostatic charge image developer that includes the color toner of the toner set according to the exemplary embodiment.

Each of the electrostatic charge image developers according to the exemplary embodiment may be a single-component developer including only the toner or a two-component developer in which the toner and a carrier are mixed.

The carrier is not particularly limited, and for example, a well-known carrier may be used. Examples of the carrier include a resin-coated carrier in which surfaces of cores formed of magnetic particles are coated with a coating resin; a magnetic particle-dispersed carrier in which magnetic particles are dispersed in a matrix resin; and a resin-impregnated carrier in which porous magnetic particles are impregnated with a resin.

In the magnetic particle-dispersed carrier or the resin-impregnated carrier, particles constituting the carrier may be used as cores, and the cores may be coated with a coating resin.

Examples of the magnetic particles include magnetic metals such as iron, nickel, and cobalt; and magnetic oxides such as ferrite and magnetite.

Examples of the coating resin and the matrix resin include polyethylene, polypropylene, polystyrene, polyvinylacetate, polyvinylalcohol, polyvinylbutyral, polyvinyl chloride, polyvinyl ether, polyvinyl ketone, vinyl chloride-vinyl acetate copolymers, styrene-acrylic acid copolymers, straight silicone resins having an organosiloxane bond and modified compounds thereof, fluorine resins, polyester, polycarbonate, phenol resins, and epoxy resins.

Other additives such as conductive particles may be added to the coating resin and the matrix resin.

Examples of conductive particles include particles of metals such as gold, silver, and copper; and particles of carbon black, titanium oxide, zinc oxide, tin oxide, barium sulfate, aluminum borate, potassium titanate, and the like.

Here, in order to coat the core with the coating resin, for example, a method is used in which the surfaces of the core particles are coated with a coating layer-forming solution obtained by dissolving the coating resin and optionally various additives in an appropriate solvent. The solvent is not particularly limited and may be selected in consideration of the coating resin to be used, coating suitability, and the like.

Examples of a specific resin coating method include a dipping method in which the cores are dipped in a coating layer-forming solution; a spray method in which a coating layer-forming solution is sprayed on the surfaces of the cores; a fluidized bed method in which a coating layer-forming resin solution is sprayed on the core particle while floating the cores with flowing air; and a kneader coater method in which the cores of the carrier and a coating layer-forming solution are mixed in a kneader coater, and then a solvent is removed.

A mixing ratio (weight ratio; toner:carrier) of the toner to the carrier in the two-component developer is preferably 1:100 to 30:100 and more preferably 3:100 to 20:100.

Image Forming Apparatus and Image Forming Method

An image forming apparatus and an image forming method according to the exemplary embodiment will be described.

An image forming apparatus according to the exemplary embodiment includes: a first image forming unit that forms a brilliant image using the brilliant toner of the toner set according to the exemplary embodiment; a second image forming unit that forms a black image using the black toner of the toner set according to the exemplary embodiment; a third image forming unit that forms a color image using the color toner of the toner set according to the exemplary embodiment; a transfer unit that transfers the brilliant image, the black image, and the color image to a recording medium; and a fixing unit that fixes the brilliant image, the black image, and the color image on the recording medium.

The image forming apparatus according to the exemplary embodiment include, as each of the first to third image forming units, an image forming unit including: an image holding member; a charging unit that charges a surface of the image holding member; an electrostatic charge image forming unit that forms an electrostatic charge image on the charged surface of the image holding member; and a developing unit that develops the electrostatic charge image, which is formed on the surface of the image holding member, using an electrostatic charge image developer to form a toner image on the surface of the image holding member.

In addition, the image forming apparatus according to the exemplary embodiment includes: an image holding member; a charging unit that charges a surface of the image holding member; an electrostatic charge image forming unit that forms an electrostatic charge image on the charged surface of the image holding member; and first to third developing units that are first to third image forming units and develop the electrostatic charge images, which are formed on the surface of the image holding member, using electrostatic charge image developers to form toner images on the surface of the image holding member.

In the image forming apparatus according to the exemplary embodiment, an image forming method (an image forming method according to the exemplary embodiment) is performed, the method including: a first image forming step of forming a brilliant image using the brilliant toner of the toner set according to the exemplary embodiment; a second image forming step of forming a black image using the black toner of the toner set according to the exemplary embodiment; a third image forming step of forming a color image using the color toner of the toner set according to the exemplary embodiment; a transfer step of transferring the brilliant image, the black image, and the color image to a recording medium; and a fixing step of fixing the brilliant image, the black image, and the color image on the recording medium.

As the image forming apparatus according to the exemplary embodiment, various well-known image forming apparatuses may be used, the apparatuses including: a direct transfer type apparatus in which a toner image (in the exemplary embodiment, the brilliant image, the black image, or the color image) formed on a surface of an image holding member is directly transferred to a recording medium; an intermediate transfer type apparatus in which a toner image formed on a surface of an image holding member is primarily transferred to a surface of an intermediate transfer member, and the toner image transferred to the surface of the intermediate transfer member is secondarily transferred to a surface of a recording medium; an apparatus including a cleaning unit that cleans a surface of an image holding member after a toner image is transferred and before charging; and an apparatus including an erasing unit that irradiates a surface of an image holding member with erasing light for erasing charged after a toner image is transferred and before charging.

In the intermediate transfer type apparatus, for example, a transfer unit includes: an intermediate transfer member having a surface to which a toner image is transferred; a primary transfer unit that primarily transfers a toner image, which is formed on a surface of an image holding member, to the surface of the intermediate transfer member; and a secondary transfer unit that secondarily transfers the toner image, which is transferred to the surface of the intermediate transfer member, to a surface of a recording medium.

Hereinafter, an example of the image forming apparatus according to the exemplary embodiment will be described, but the image forming apparatus is not limited thereto. In the following description, major components shown in the drawings will be described, and the other components will not be described. In the following description regarding an example of the toner set according to the exemplary embodiment, the brilliant toner will be referred to as "silver toner".

Figure 2:
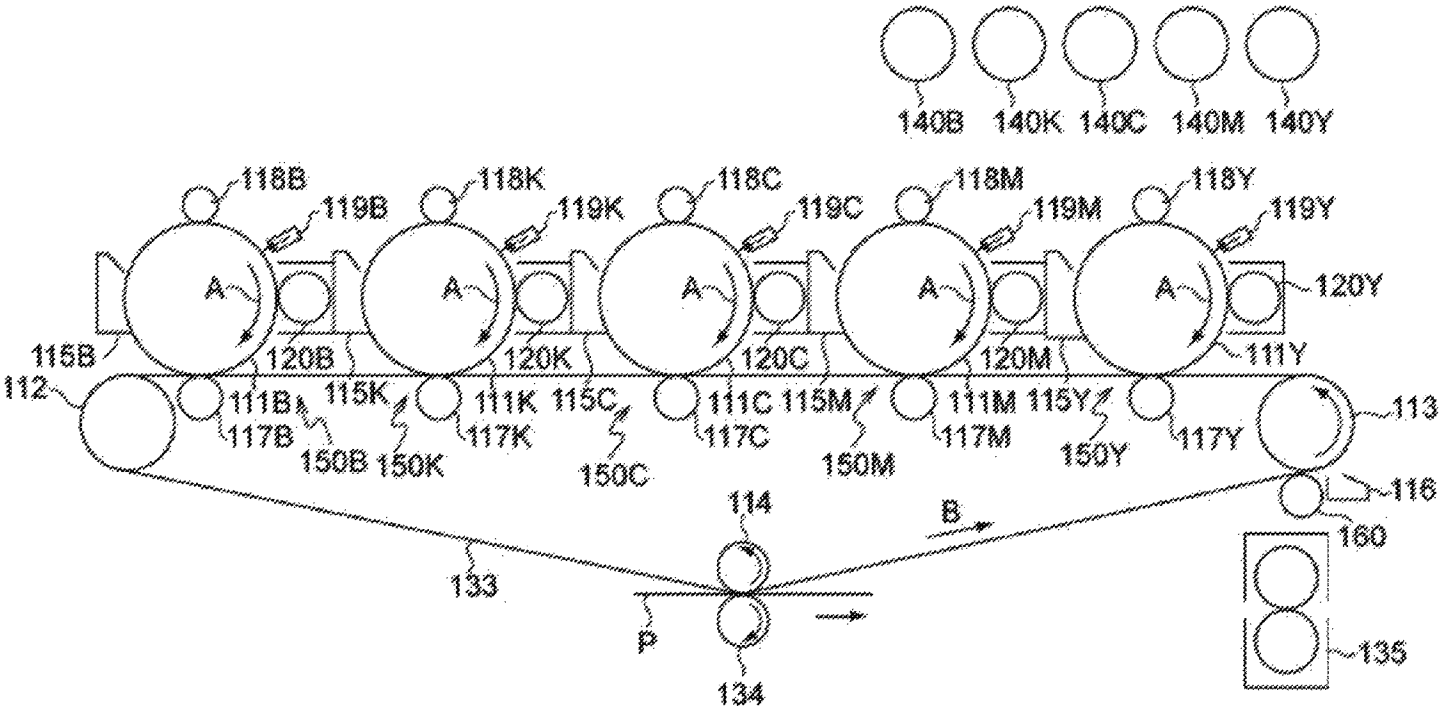
FIG. 2 is a diagram schematically showing a configuration of an example of an image forming apparatus according to an exemplary embodiment of the invention.

FIG. 2 is a diagram schematically showing a configuration of the image forming apparatus according to the exemplary embodiment which is a quintuple tandem type and an intermediate transfer type image forming apparatus.

The image forming apparatus shown in FIG. 2, includes first to fifth electrophotographic image forming units 150Y, 150M, 150C, 150K, and 150B (image forming units) that form images of the respective colors including yellow (Y), magenta (M), cyan (C), black (K), and silver (B) based on color-separated image data. These image forming units (hereinafter, also simply referred to as "units") 150Y, 150M, 150C, 150K, and 150B are horizontally arranged in parallel at predetermined intervals. These units 150Y, 150M, 150C, 150K, and 150B may be process cartridges which are detachable from the image forming apparatus.

An intermediate transfer belt 133 (an example of the intermediate transfer member) extends through a region below the respective units 150Y, 150M, 150C, 150K, and 150B. The intermediate transfer belt 133 is wound around a drive roller 113, a support roller 112, and a counter roller 114 which contact with the inner surface of the intermediate transfer belt 133. The intermediate transfer belt 133 travels in a direction moving from the first unit 150Y to the fifth unit 150B (in FIG. 2, a direction indicated by arrow B). In addition, an intermediate transfer member cleaning device 116 is provided on an image holding member-side surface of the intermediate transfer belt 133 to be opposite to the drive roller 113. On an upstream side of the intermediate transfer member cleaning device 116 in a rotating direction of the intermediate transfer belt 133, a voltage applying device 160 is provided which generates an electric field between the intermediate transfer member cleaning device 116 and the intermediate transfer belt 133 by generating a potential difference between the intermediate transfer member cleaning device 116 and the support roller 112.

In addition, the respective toners of yellow, magenta, cyan, black, and silver which are contained in toner cartridges 140Y, 140M, 140C, 140K, and 140B are supplied to developing devices (examples of the developing units) 120Y, 120M, 120C, 120K, and 120B of the respective units 150Y, 150M, 150C, 150K, and 150B respectively.

Since the first to fifth units 150Y, 150M, 150C, 150K, and 150B have the same configuration, operation, and action, the first unit 150Y which is arranged on an upstream side in the traveling direction of the intermediate transfer belt and forms a yellow image will be described as a representative example.

The first unit 150Y includes a photoreceptor 111Y which functions as the image holding member. In the vicinity of the photoreceptor 111Y, a charging roller 118Y (an example of the charging unit) that charges a surface of the photoreceptor 111Y to a predetermined potential; an exposure device 119Y (an example of the electrostatic charge image forming unit) that exposes the charged surface to a laser beam based on a color-separated image signal to form an electrostatic charge image thereon; a developing device 120Y (an example of the developing unit) that supplies toner to the electrostatic charge image to develop the electrostatic charge image; a primary transfer roller 117Y (an example of the primary transfer unit) that transfers the developed toner image to the intermediate transfer belt 133; and a photoreceptor cleaning device 115Y (an example of the cleaning unit) that removes the toner remaining on the surface of the photoreceptor 111Y after the primary transfer, are arranged in this order.

The primary transfer roller 117Y is arranged inside the intermediate transfer belt 133 and is provided at a position opposite to the photoreceptor 111Y. Further, bias power supplies (not shown) are connected to the primary transfer rollers 117Y, 117M, 117C, 117K, and 117B of the respective units to apply primary transfer biases thereto. A controller (not shown) controls the respective bias power supply to change the transfer bias values which are applied to the respective primary transfer rollers.

Hereinafter, the operation of forming the yellow image in the first unit 150Y will be described.

First, before the operation, the surface of the photoreceptor 111Y is charged to a potential of −600 V to −800 V by the charging roller 118Y.

The photoreceptor 111Y is formed by laminating a photosensitive layer on a conductive substrate (for example, volume resistivity at 20° C.: $1\times10^{-6}$ Ω/cm or lower). This photosensitive layer typically has high resistance (resistance of a general resin) but has a property in which, when being irradiated with the laser beam, the specific resistance of the portion irradiated with the laser beam changes. Therefore, the charged surface of the photoreceptor 111Y is irradiated with the laser beam through the exposure device 119Y according to image data for yellow sent from the controller (not shown). As a result, an electrostatic charge image having a yellow image pattern is formed on the surface of the photoreceptor 111Y.

The electrostatic charge image is an image which is formed on the surface of the photoreceptor 111Y by charging and is a so-called negative latent image which is formed when the specific resistance of a portion, which is irradiated with the laser beam emitted from the exposure device 119Y, of the photosensitive layer is reduced and the charge flows on the surface of the photoreceptor 111Y, and when the charge remains in a portion which is not irradiated with the laser beam.

The electrostatic charge image formed on the photoreceptor 111Y is rotated to a predetermined development position along with the traveling of the photoreceptor 111Y. At this development position, the electrostatic charge image on the photoreceptor 111Y is developed and visualized as a toner image by the developing device 120Y.

The developing device 120Y contains, for example, an electrostatic charge image developer containing at least a yellow toner and a carrier. The yellow toner is frictionally charged by being agitated in the developing device 120Y to have a charge having the same polarity (negative polarity) as that of a charge on the photoreceptor 111Y and is maintained on a developer roller (an example of the developer holding member). When the surface of the photoreceptor 111Y passes through the developing device 120Y, the yellow toner is electrostatically attached to a latent image portion on the surface of the photoreceptor 111Y which is erased, and the latent image is developed with the yellow toner. The photoreceptor 111Y on which a yellow toner image is formed continuously travels at a predetermined rate, and the toner image developed on the photoreceptor 111Y is transported to a predetermined primary transfer position.

When the yellow toner image on the photoreceptor 111Y is transported to the primary transfer position, a primary transfer bias is applied to the primary transfer roller 117Y, an electrostatic force is applied to the toner image in a direction moving from the photoreceptor 111Y to the primary transfer roller 117Y, and the toner image on the photoreceptor 111Y is transferred to the intermediate transfer belt 133. The transfer bias applied at this time has a positive polarity opposite to the negative polarity of the toner. The first unit 150Y is controlled to +10 μA by the controller (not shown).

On the other hand, the toner remaining on the photoreceptor 111Y is removed and collected by the photoreceptor cleaning device 115Y.

In addition, primary transfer biases which are applied to the primary transfer rollers 117M, 117C, 117K, and 117B of the second unit 150M and subsequent units, respectively, are controlled in a similarly way to that of the primary transfer bias of the first unit.

In this way, the intermediate transfer belt 133 to which the yellow toner image is transferred by the first unit 150Y is sequentially transported through the second to fifth units 150M, 150C 150K, and 150B, and toner images of the respective colors are transferred and layered.

The intermediate transfer belt 133 to which the five color toner images are transferred and layered by the first to fifth units reaches a secondary transfer portion which is configured with the intermediate transfer belt 133, the counter roller 114, and a secondary transfer roller 134 (an example of the secondary transfer unit) which is provided on an image-holding side of the intermediate transfer belt 133. Meanwhile, a recording sheet P (an example of the recording medium) is supplied to a gap at which the secondary transfer roller 134 and the intermediate transfer belt 133 contact with each other at a predetermined timing through a supply mechanism, and a predetermined secondary transfer bias is applied to the counter roller 114. The transfer bias applied at this time has the negative polarity which is the same as the polarity of the toner, and an electrostatic force is applied to the toner image in a direction moving from the intermediate transfer belt 133 to the recording sheet P. As a result, the toner image on the intermediate transfer belt 133 is transferred to the recording sheet P. At this time, the secondary transfer bias is determined depending on a resistance detected by a resistance detecting unit (not shown) which detects a resistance of the secondary transfer portion, and the voltage is controlled.

Thereafter, the recording sheet P is transported to a nip portion of a pair of fixing rollers in a fixing device 135 (an example of the fixing unit), and the toner image is fixed onto the recording sheet P to form a fixed image.

Examples of the recording sheet P to which the toner image is transferred include plain paper used for electrophotographic copying machines, printers and the like. As the recording medium, in addition to the recording sheet P, OHP sheets may be used.

In order to improve the smoothness of the image surface after the fixing, the surface of the recording sheet P is preferably smooth, and for example, coated paper obtained by coating the surface of plain paper with a resin or the like, or art paper for printing is suitably used.

The recording sheet P onto which a color image is completely fixed is discharged to an exit port, and a series of the color image formation operations ends.

The image forming apparatus shown in FIG. 2 has a configuration in which the toner cartridges 140Y, 140M, 140C, 140K, and 140B are detachable therefrom, and the developing devices 120Y, 120M, 120C, 120K, and 120B are connected to the toner cartridges corresponding to the respective developing devices (colors) through toner supply pipes (not shown). In addition, when the amount of toner contained in a toner cartridge is insufficient, this toner cartridge is replaced with a new one.

Process Cartridge and Toner Cartridge Set

A process cartridge according to the exemplary embodiment will be described.

A process cartridge according to the exemplary embodiment is detachable from an image forming apparatus and includes: a first developing unit that contains the first electrostatic charge image developer of the electrostatic charge image developer set according to the exemplary embodiment; a second developing unit that contains the second electrostatic charge image developer of the electrostatic charge image developer set according to the exemplary embodiment; and a third developing unit that contains the third electrostatic charge image developer of the electrostatic charge image developer set according to the exemplary embodiment.

In addition, the process cartridge according to the exemplary embodiment is not limited to the above-described configuration, and may include the developing device and optionally at least one component selected from other units such as an image holding member, a charging unit, an electrostatic charge image forming unit, and a transfer unit.

Hereinafter, an example of the process cartridge according to the exemplary embodiment will be described, but the process cartridge is not limited thereto. Major components shown in the drawings will be described, and the other components will not be described.

Figure 3:
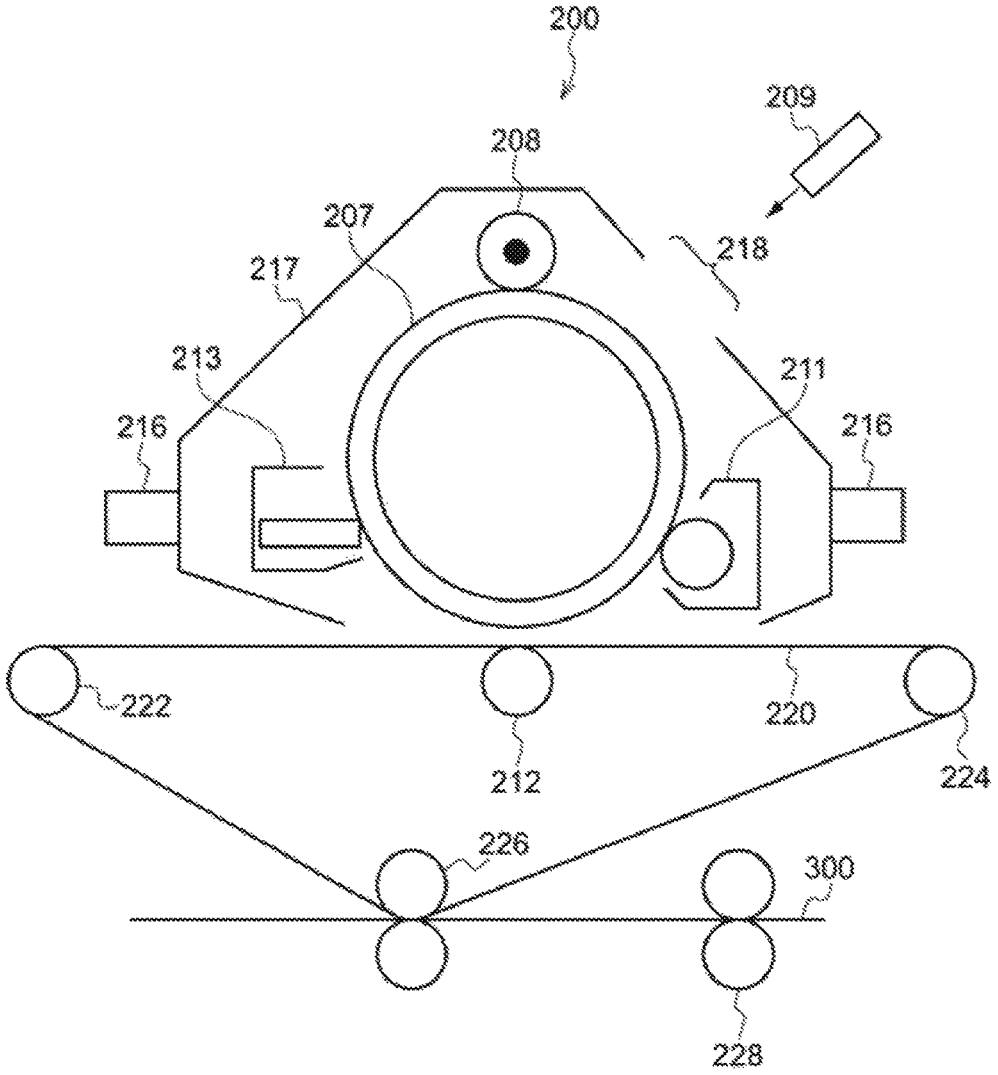
FIG. 3 is a diagram schematically showing a configuration of an example of a process cartridge according to an exemplary embodiment of the invention.

FIG. 3 is a diagram schematically showing a configuration of the process cartridge according to the exemplary embodiment.

A process cartridge 200 shown in FIG. 3 is, for example, a cartridge in which a photoreceptor 207 (an example of the image holding member), and a charging roller 208 (an example of the charging unit), a developing device 211 (an example of the developing unit), and a photoreceptor cleaning device 213 (an example of the cleaning unit), which are provided around the photoreceptor 207 are integrally combined in a housing 217 including amounting rail 216 and an opening 218 for exposure.

In FIG. 3, reference numeral 209 represents an exposure device (an example of the electrostatic charge image forming unit), reference numeral 212 represents a primary transfer roller (an example of the primary transfer unit), reference numeral 220 represents an intermediate transfer belt (an example of the intermediate transfer member), reference numeral 222 represents a drive roller (an example of the intermediate transfer member erasing unit) which also functions as an intermediate transfer belt erasing unit, reference numeral 224 represents a support roller, reference numeral 226 represents a secondary transfer roller (an example of the secondary transfer unit), reference numeral 228 represents a fixing device (an example of the fixing unit), and reference numeral 300 represents a recording sheet (an example of the recording medium).

Next, a toner cartridge set according to the exemplary embodiment will be described.

A toner cartridge set according to the exemplary embodiment is detachable from an image forming apparatus and includes: a first toner cartridge that contains the brilliant toner of the toner set according to the exemplary embodiment; a second toner cartridge that contains the black toner of the toner set according to the exemplary embodiment; and a third toner cartridge that contains the color toner of the toner set according to the exemplary embodiment.

Each of the toner cartridge contains a replenishment toner which is supplied to each of developing units provided in an image forming apparatus.

EXAMPLES

Hereinafter, the exemplary embodiment will be described in detail using Examples but is not limited to these examples.

Hereinafter, unless specified otherwise, "part(s)" and "%" represent "part(s) by weight" and "% by weight".

Synthesis of Crystalline Polyester Resin and Preparation of Crystalline Resin Particle Dispersion Preparation of Crystalline Polyester Resin (P1) and Crystalline Resin Particle Dispersion (P1)

n-dodecanedioic acid (1,10-decanedicarboxylic acid): 100 parts by mol 1,9-nonanediol: 100 parts by mol Dibutyltin oxide (catalyst): 0.3 parts with respect to 100 parts of the total amount of n-dodecanedioic acid and 1,9-nonanediol The above-described materials are put into a three-necked flask which is heated and dried, the internal atmosphere of the flask is substituted with nitrogen gas to be in an inert atmosphere by evacuating, and the materials are stirred at 180° C. for 2 hours. Next, the solution is slowly heated to 200° C. under reduced pressure and is stirred for 2 hours until the solution is viscous. Then, the solution is air-cooled and the reaction is stopped. As a result, a crystalline polyester resin (P1) having a weight average molecular weight (Mw) of 5,800 is obtained.

Next 3,000 parts of the crystalline polyester resin (P1), 10,000 parts of ion exchange water, and 100 parts of sodium dodecylbenzenesulfonate as a dispersant are put into an emulsification tank of an emulsification device (CAVITRON CD1010, slit: 0.4 mm), are heated and melted at 130° C., are dispersed at 110° C. and 10,000 rpm for 30 minutes, and are caused to pass through a cooling tank at a flow rate of 3 L/m. Next, the resin particle dispersion is collected. As a result, a crystalline resin particle dispersion (P1) having a solid content of 20.0% is obtained. The volume average particle diameter D50v of particles included in the obtained crystalline resin particle dispersion (P1) is 0.25 μm.

Synthesis of Crystalline Polyester Resin (P2) and Preparation of Crystalline Resin Particle Dispersion (P2)

A crystalline polyester resin (P2) having a weight average molecular weight (Mw) of 5,700 is obtained using the same synthesis method as that of the crystalline polyester resin (P1), except that 1,6-hexanediol is used instead of 1,9-nonanediol.

Next, a crystalline resin particle dispersion (P2) having a solid content of 20.0% is prepared using the same preparation method as that of the crystalline resin particle dispersion (P1). The volume average particle diameter D50v of particles included in the obtained crystalline resin particle dispersion (P2) is 0.22 μm.

Synthesis of Crystalline Polyester Resin (P3) and Preparation of Crystalline Resin Particle Dispersion (P3)

A crystalline polyester resin (P3) having a weight average molecular weight (Mw) of 6,000 is obtained using the same synthesis method as that of the crystalline polyester resin (P1), except that: n-decanedioic acid (1,8-octanedicarboxylic acid, sebacic acid) is used instead of n-dodecanedioic acid; and 1,6-hexanediol is used instead of 1,9-nonanediol.

Next, a crystalline resin particle dispersion (P3) having a solid content of 20.0% is prepared using the same preparation method as that of the crystalline polyester resin particle dispersion (P1). The volume average particle diameter D50v of particles included in the obtained crystalline resin particle dispersion (P3) is 0.22 μm.

Synthesis of Amorphous Polyester Resin and Preparation of Amorphous Resin Particle Dispersion Terephthalic acid: 30 parts by mol Fumaric acid: 70 parts by mol Ethylene oxide adduct of bisphenol A: 5 parts by mol Propylene oxide adduct of bisphenol A: 95 parts by mol The above-described materials are put into a flask having an internal capacity of 5 L and including a stirrer, a nitrogen introducing pipe, a temperature sensor, and a rectification tower, the temperature is increased to 220° C. for 1 hour, and 1 part of titanium tetraethoxide is added with respect to 100 parts of the materials. While removing produced water by distillation, the temperature is increased to 230° C. for 0.5 hours, a dehydration condensation reaction is continued at this temperature for 1 hour, and the reactant is cooled. As a result, an amorphous polyester resin having a weight average molecular weight of 18,000, an acid value of 15 mgKOH/g, and a glass transition temperature of 60° C. is synthesized.

40 parts of ethyl acetate and 25 parts of 2-butanol are put into a container including a temperature adjusting unit and a nitrogen substitution unit to prepare a mixed solvent. Next, 100 parts of the amorphous polyester resin is slowly dissolved in the mixed solvent, and a 10% by weight ammonia aqueous solution (amount equivalent to three times the acid value of the resin by molar ratio) is added to the solution, and the components are stirred for 30 minutes.

Next, the internal atmosphere of the container is substituted with dry nitrogen. While keeping the temperature at 40° C. and stirring the mixed solution, 400 parts of ion exchange water is added dropwise at a rate of 2 part/min and emulsified. After the completion of the dropwise addition, the temperature of the emulsion returns to room temperature (20° C. to 25° C.), and dry nitrogen is bubbled through the emulsion for 48 hours while stirring the emulsion. As a result, the concentration of ethyl acetate and 2-butanol is reduced to 1,000 ppm, and a resin particle dispersion in which resin particles having a volume average particle diameter of 200 nm are dispersed is obtained. Ion exchange water is added to the resin particle dispersion to adjust the solid content to 20% by weight. As a result, an amorphous resin particle dispersion is obtained.

Preparation of Brilliant Pigment Dispersion

Preparation of Brilliant Pigment Dispersion (B1)

Aluminum pigment (2173EA, manufactured by Toyo Aluminum K.K.): 100 parts

Anionic surfactant (NEOGEN R, manufactured by Dai-ichi Kogyo Seiyaku Co. Ltd.): 1.5 parts Ion exchange water: 400 parts After removing a solvent from a paste of the aluminum pigment, the above-described materials are mixed with each other and are dispersed using an emulsifying dispersing device CAVITRON (CR1010, manufactured by Pacific Machinery & Engineering Co., Ltd.) for 1 hour. As a result, a brilliant pigment dispersion (B1) (solid content: 20%) in which the brilliant pigment (aluminum pigment) is dispersed is prepared.

Preparation of Colorant Dispersion

Preparation of Colorant Dispersion (K1)

Black pigment (NIPEX, manufactured by Orion Engineered Carbons S.A.): 70 parts

Anionic surfactant (NEOGEN RK, manufactured by Dai-ichi Kogyo Seiyaku Co. Ltd.): 1 part Ion exchange water: 200 parts The above-described materials are mixed with each other and are stirred using a homogenizer (ULTRA TURRAX T50, manufactured by IKA) for 10 minutes. Ion exchange water is added such that the solid content in the dispersion is 20% by weight. As a result, a colorant dispersion (K1) in which colorant particles having a volume average particle diameter of 190 nm is obtained.

Preparation of Colorant Dispersion (Y1)

Yellow pigment (Hansa Yellow 5GX01, manufactured by Clariant Japan K.K.): 70 parts Anionic surfactant (NEOGEN RK, manufactured by Dai-ichi Kogyo Seiyaku Co. Ltd.): 1 part Ion exchange water: 200 parts The above-described materials are mixed with each other and are stirred using a homogenizer (ULTRA TURRAX T50, manufactured by IKA) for 10 minutes. Ion exchange water is added such that the solid content in the dispersion is 20% by weight. As a result, a colorant dispersion (Y1) in which colorant particles having a volume average particle diameter of 190 nm is obtained.

Preparation of Colorant Dispersion (M1)

Magenta pigment (C.I. Pigment Red 238, manufactured by Sanyo Color Works Ltd.): 70 parts Anionic surfactant (NEOGEN RK, manufactured by Dai-ichi Kogyo Seiyaku Co. Ltd.): 1 part Ion exchange water: 200 parts The above-described materials are mixed with each other and are stirred using a homogenizer (ULTRA TURRAX T50, manufactured by IKA) for 10 minutes. Ion exchange water is added such that the solid content in the dispersion is 20% by weight. As a result, a colorant dispersion (M1) in which colorant particles having a volume average particle diameter of 190 nm is obtained.

Preparation of Colorant Dispersion (C1)

Cyan pigment (C.I. Pigment Blue 15:3, manufactured by Dainichiseika Color & Chemicals Mfg. Co., Ltd.): 70 parts Anionic surfactant (NEOGEN RK, manufactured by Dai-ichi Kogyo Seiyaku Co. Ltd.): 1 part Ion exchange water: 200 parts The above-described materials are mixed with each other and are stirred using a homogenizer (ULTRA TURRAX T50, manufactured by IKA) for 10 minutes. Ion exchange water is added such that the solid content in the dispersion is 20% by weight. As a result, a colorant dispersion (C1) in which colorant particles having a volume average particle diameter of 190 nm is obtained.

Preparation of Release Agent Dispersion

Paraffin wax (HNP-9 manufactured by Nippon Seiro Co. Ltd.): 100 parts

Anionic surfactant (NEOGEN RK, manufactured by Dai-ichi Kogyo Seiyaku Co. Ltd.): 1 part Ion exchange water: 350 parts The above-described materials are mixed, are heated to 100° C., are dispersed using a homogenizer (ULTRA TURRAX T50, manufactured by IKA), are further dispersed using a MANTON-GAULIN high-pressure homogenizer (manufactured by Gaulin). As a result, a release agent dispersion (solid content: 20% by weight) in which release agent particles having a volume average particle diameter of 200 nm are dispersed is obtained.

Preparation of Brilliant Toner

Preparation of Brilliant Toner (BR1)

Crystalline resin dispersion (P1): 32.4 parts

Amorphous resin particle dispersion: 372.6 parts

Brilliant pigment dispersion (B1): 150 parts

Release agent dispersion: 50 parts

Nonionic surfactant (IGEPAL CA897): 1.4 parts

The above-described materials are put into a 2 L cylindrical stainless steel container and are dispersed and mixed with each other using a homogenizer (ULTRA TURRAX T50, manufactured by IKA) for 10 minutes while applying a shearing force at 4,000 rpm. Next, 1.75 parts of a 10% nitric acid aqueous solution of polyaluminum chloride as a coagulant is slowly added dropwise, and the components are dispersed and mixed with each other for 15 minutes at a rotating speed of the homogenizer of 5,000 rpm to prepare a raw material dispersion.

Next, the aggregated particle dispersion is put into a polymerization tank including a stirrer with two paddles of stirring blades and a thermometer, and is heated using a mantle heater while being stirred at a stirring rotating speed of 550 rpm to accelerate the growth of aggregated particles at 54° C. At this time, pH of the raw material dispersion is adjusted to be in a range of 2.2 to 3.5 using 0.3 N nitric acid and 1 N sodium hydroxide aqueous solution. The pH range is kept for about 2 hours to form aggregated particles. At this time, the volume average particle diameter of the aggregated particle is 10.6 μm when measured using COULTER MULTISIZER II (aperture diameter: 50 μm, manufactured by Beckman Coulter Inc.).

Next, 100 parts of the amorphous resin particle dispersion is added to deposit resin particles on surfaces of the aggregated particles. At an increased temperature of 56° C., the aggregated particles are adjusted while observing the size and form of the particles using an optical microscope and COULTER MULTISIZER II.

Next, after increasing pH to 8.0 in order to cause the aggregated particles to coalesce, the temperature is increased to 80° C. at a rate of 0.01° C./min. After verifying that the aggregated particles coalesce using an optical microscope, pH is decreased to 6.0 while keeping the temperature at 80° C. After 2.5 hours, the heating is stopped, and the particles are cooled at a temperature decrease rate of 1.0° C./min. Next, the particles are sieved through a 20 μm mesh, is repeatedly washed with water, and is dried using a vacuum dryer. As a result, brilliant toner particles (B1) are obtained. The volume average particle diameter of the brilliant toner particles (B1) is 12.5 μm.

100 parts of the brilliant toner particles (B1) and 1.5 parts of hydrophobic silica (RY50, manufactured by Nippon Aerosil Co., Ltd.) are mixed with each other using a sample mill at 10,000 rpm for 30 seconds. Next, the mixture is sieved through a vibration sieve having an opening of 45 μm. As a result, a brilliant toner (BR1) is prepared.

Preparation of Brilliant Toners (BR2) to (BR7)

Brilliant toners (BR2) to (BR7) are prepared using the same preparation method as that of the brilliant toner (BR1), except that the kind and amount of the crystalline resin particle dispersion, the amount of the amorphous resin particle dispersion (the amount in the raw material dispersion), the kind and amount of the brilliant pigment dispersion, and the kind and amount of the colorant dispersion are changed as shown in Table 1. All the volume average particle diameters of the brilliant toners (BR2) to (BR7) are 12.5 μm.

Preparation of Brilliant Toner (BR8)

Crystalline resin particle dispersion (P1): 34 parts

Amorphous resin particle dispersion: 391 parts

Brilliant pigment dispersion (B1): 160 parts

Release agent dispersion: 50 parts

Nonionic surfactant (IGEPAL CA897): 2 parts

The above-described materials are put into a stainless steel round bottom flask, and 0.1 N nitric acid is added to adjust pH to 3.5. Next, 30 parts of a nitric acid aqueous solution having a polyaluminum chloride concentration of 10% by weight is added. Next, the components are dispersed at 30° C. using a homogenizer (ULTRA TURRAX T50, manufactured by IKA), are heated to 45° C. in a heating oil bath, and are kept at this temperature for 30 minutes. As a result, a raw material dispersion is prepared. Next, 50 parts of the amorphous resin particle dispersion is added to deposit resin particles on surfaces of the aggregated particles. At an increased temperature of 56° C., the dispersion is slowly added and kept for 1 hour. Next, a 0.1 N sodium hydroxide aqueous solution is added to the dispersion to adjust pH to 8.5, and then the dispersion is heated to 85° C. while stirring the dispersion. This state is kept for 5 hours. Next, the dispersion is cooled to 20° C. at a rate of 20° C./min, is filtered, is sufficiently washed with ion exchange water, and is dried. As a result, brilliant toner particles (B8) having a volume average particle diameter of 7.5 μm is obtained.

100 parts of the brilliant toner particles (B8) and 1.5 parts of hydrophobic silica (RY50, manufactured by Nippon Aerosil Co., Ltd.) are mixed with each other using a sample mill at 10,000 rpm for 30 seconds. Next, the mixture is sieved through a vibration sieve having an opening of 45 As a result, a brilliant toner (BR8) is prepared.

Preparation of Brilliant Toner (BR9)

Crystalline resin particle dispersion (P1): 29 parts

Amorphous resin particle dispersion: 333.5 parts

Brilliant pigment dispersion (B1): 135 parts

Release agent dispersion: 50 parts

Nonionic surfactant (IGEPAL CA897): 2 parts

The above-described materials are put into a stainless steel round bottom flask, and 0.1 N nitric acid is added to adjust pH to 3.5. Next, 30 parts of a nitric acid aqueous solution having a polyaluminum chloride concentration of 10% by weight is added. Next, the components are dispersed at 30° C. using a homogenizer (ULTRA TURRAX T50, manufactured by IKA), are heated to 45° C. in a heating oil bath, and are kept at this temperature for 30 minutes. As a result, a raw material dispersion is prepared. Next, 150 parts of the amorphous resin particle dispersion is added to deposit resin particles on surfaces of the aggregated particles. At an increased temperature of 56° C., the dispersion is slowly added and kept for 1 hour. Next, a 0.1 N sodium hydroxide aqueous solution is added to the dispersion to adjust pH to 8.5, and then the dispersion is heated to 85° C. while stirring the dispersion. This state is kept for 5 hours. Next, the dispersion is cooled to 20° C. at a rate of 20° C./min, is filtered, is sufficiently washed with ion exchange water, and is dried. As a result, brilliant toner particles (B9) having a volume average particle diameter of 7.5 μm is obtained.

100 parts of the brilliant toner particles (B9) and 1.5 parts of hydrophobic silica (RY50, manufactured by Nippon Aerosil Co., Ltd.) are mixed with each other using a sample mill at 10,000 rpm for 30 seconds. Next, the mixture is sieved through a vibration sieve having an opening of 45 As a result, a brilliant toner (BR9) is prepared.

TABLE 1

| | Crystalline Resin Particle Dispersion | | Amorphous Resin Particle Dispersion | Brilliant Pigment Dispersion | | Colorant Dispersion | | Dielectric Loss Factor |
|---|---|---|---|---|---|---|---|---|
| | Kind | Part (s) | Part (s) | Kind | Part (s) | Kind | Part (s) | ($\times 10^{-3}$) |
| Brilliant Toner (BR1) | P1 | 32.4 | 372.6 | B1 | 150 | — | — | 60 |
| Brilliant Toner (BR2) | P2 | 32.4 | 372.6 | B1 | 150 | — | — | 68 |
| Brilliant Toner (BR3) | P1 | 32.4 | 372.6 | B1 | 140 | Y1 | 10 | 65 |
| Brilliant Toner (BR4) | P1 | 81 | 324 | B1 | 150 | — | — | 63 |
| Brilliant Toner (BR5) | P1 | 34 | 391 | B1 | 160 | — | — | 90 |
| Brilliant Toner (BR6) | P1 | 30 | 345 | B1 | 140 | — | — | 48 |
| Brilliant Toner (BR7) | P1 | 29 | 333.5 | B1 | 135 | — | — | 35 |

TABLE 1-continued

| | Crystalline Resin Particle Dispersion | | Amorphous Resin Particle Dispersion | Brilliant Pigment Dispersion | | Colorant Dispersion | | Dielectric Loss Factor |
|---|---|---|---|---|---|---|---|---|
| | Kind | Part (s) | Part (s) | Kind | Part (s) | Kind | Part (s) | ($\times 10^{-3}$) |
| Brilliant Toner (BR8) | P1 | 34 | 391 | B1 | 160 | — | — | 120 |
| Brilliant Toner (BR9) | P1 | 29 | 333.5 | B1 | 135 | — | — | 30 |

Preparation of Black Toner

Preparation of Black Toner (KE1)

Crystalline resin particle dispersion (P1): 31 parts

Amorphous resin particle dispersion: 444 parts

Colorant dispersion (K1): 50 parts

Release agent dispersion: 50 parts

Anionic surfactant (TAYCA POWER): 2 parts

The above-described materials are put into a stainless steel round bottom flask, and 0.1 N nitric acid is added to adjust pH to 3.5. Next, 30 parts of a nitric acid aqueous solution having a polyaluminum chloride concentration of 10% by weight is added. Next, the components are dispersed at 30° C. using a homogenizer (ULTRA TURRAX T50, manufactured by IKA), are heated to 45° C. in a heating oil bath, and are kept at this temperature for 30 minutes. As a result, a raw material dispersion is prepared. Next, 100 parts of the amorphous resin particle dispersion is added to deposit resin particles on surfaces of the aggregated particles. At an increased temperature of 56° C., the dispersion is slowly added and kept for 1 hour. Next, a 0.1 N sodium hydroxide aqueous solution is added to the dispersion to adjust pH to 8.5, and then the dispersion is heated to 85° C. while stirring the dispersion. This state is kept for 5 hours. Next, the dispersion is cooled to 20° C. at a rate of 20° C./min, is filtered, is sufficiently washed with ion exchange water, and is dried. As a result, black toner particles (K1) having a volume average particle diameter of 7.5 μm is obtained.

100 parts of the black toner particles (K1) and 1.5 parts of hydrophobic silica (RY50, manufactured by Nippon Aerosil Co., Ltd.) are mixed with each other using a sample mill at 10,000 rpm for 30 seconds. Next, the mixture is sieved through a vibration sieve having an opening of 45 μm. As a result, a black toner (KE1) is prepared.

Preparation of Black Toners (KE2) to (KE5)

Black toners (KE2) to (KE5) are prepared using the same preparation method as that of the black toner (KE1), except that the kind and amount of the crystalline resin particle dispersion, the amount of the amorphous resin particle dispersion (the amount in the raw material dispersion), and the kind and amount of the colorant dispersion are changed as shown in Table 2. All the volume average particle diameters of the black toners (KE2) to (KE5) are 7.5 μm.

Preparation of Black Toner (KE6)

Crystalline resin particle dispersion (P2): 29 parts

Amorphous resin particle dispersion: 423 parts

Colorant dispersion (K1): 50 parts

Release agent dispersion: 50 parts

Anionic surfactant (TAYCA POWER): 2 parts

The above-described materials are put into a stainless steel round bottom flask, and 0.1 N nitric acid is added to adjust pH to 3.5. Next, 30 parts of a nitric acid aqueous solution having a polyaluminum chloride concentration of 10% by weight is added. Next, the components are dispersed at 30° C. using a homogenizer (ULTRA TURRAX T50, manufactured by IKA), are heated to 45° C. in a heating oil bath, and are kept at this temperature for 30 minutes. As a result, a raw material dispersion is prepared. Next, 50 parts of the amorphous resin particle dispersion is added to deposit resin particles on surfaces of the aggregated particles. At an increased temperature of 56° C., the dispersion is slowly added and kept for 1 hour. Next, a 0.1 N sodium hydroxide aqueous solution is added to the dispersion to adjust pH to 8.5, and then the dispersion is heated to 85° C. while stirring the dispersion. This state is kept for 5 hours. Next, the dispersion is cooled to 20° C. at a rate of 20° C./min, is filtered, is sufficiently washed with ion exchange water, and is dried. As a result, black toner particles (K6) having a volume average particle diameter of 7.5 μm is obtained.

100 parts of the black toner particles (K6) and 1.5 parts of hydrophobic silica (RY50, manufactured by Nippon Aerosil Co., Ltd.) are mixed with each other using a sample mill at 10,000 rpm for 30 seconds. Next, the mixture is sieved through a vibration sieve having an opening of 45 μm. As a result, a black toner (KE6) is prepared.

TABLE 2

| | Crystalline Resin Particle Dispersion | | Amorphous Resin Particle Dispersion | Colorant Dispersion | | Dielectric Loss Factor |
|---|---|---|---|---|---|---|
| | Kind | Part (s) | Part (s) | Kind | Part (s) | ($\times 10^{-3}$) |
| Black Toner (KE1) | P1 | 31 | 444 | K1 | 50 | 15 |
| Black Toner (KE2) | P2 | 31 | 444 | K1 | 50 | 20 |
| Black Toner (KE3) | P3 | 31 | 444 | K1 | 50 | 30 |
| Black Toner (KE4) | P1 | 77 | 398 | K1 | 50 | 25 |
| Black Toner (KE5) | P2 | 32 | 466 | K1 | 55 | 33 |
| Black Toner (KE6) | P2 | 29 | 423 | K1 | 50 | 35 |

Preparation of Color Toner

Preparation of Yellow Toners (YE1) to (YE5)

Yellow toners (YE1) to (YE5) are prepared using the same preparation method as that of the black toner (KE1), except that the kind and amount of the crystalline resin particle dispersion, the amount of the amorphous resin particle dispersion (the amount in the raw material dispersion), and the kind and amount of the colorant dispersion are changed as shown in Table 3. All the volume average particle diameters of the yellow toners (YE1) to (YE5) are 7.5 μm.

TABLE 3

| | Crystalline Resin Particle Dispersion | | Amorphous Resin Particle Dispersion | Colorant Dispersion | | Dielectric Loss Factor |
|---|---|---|---|---|---|---|
| | Kind | Part (s) | Part (s) | Kind | Part (s) | ($\times 10^{-3}$) |
| Yellow Toner (YE1) | P1 | 31 | 444 | Y1 | 50 | 10 |
| Yellow Toner (YE2) | P2 | 31 | 444 | Y1 | 50 | 15 |
| Yellow Toner (YE3) | P3 | 31 | 444 | Y1 | 50 | 25 |
| Yellow Toner (YE4) | P1 | 77 | 398 | Y1 | 50 | 20 |
| Yellow Toner (YE5) | P2 | 33 | 473 | Y1 | 58 | 35 |

Preparation of Magenta Toners (MA1) to (MA5)

Magenta toners (MA1) to (MA5) are prepared using the same preparation method as that of the black toner (KE1), except that the kind and amount of the crystalline resin particle dispersion, the amount of the amorphous resin particle dispersion (the amount in the raw material dispersion), and the kind and amount of the colorant dispersion are changed as shown in Table 4. All the volume average particle diameters of the magenta toners (MA1) to (MA5) are 7.5 μm.

TABLE 4

| | Crystalline Resin Particle Dispersion | | Amorphous Resin Particle Dispersion | Colorant Dispersion | | Dielectric Loss Factor |
|---|---|---|---|---|---|---|
| | Kind | Part (s) | Part (s) | Kind | Part (s) | ($\times 10^{-3}$) |
| Magenta Toner (MA1) | P1 | 31 | 444 | M1 | 50 | 10 |
| Magenta Toner (MA2) | P2 | 31 | 444 | M1 | 50 | 15 |
| Magenta Toner (MA3) | P3 | 31 | 444 | M1 | 50 | 25 |
| Magenta Toner (MA4) | P1 | 77 | 398 | M1 | 50 | 20 |
| Magenta Toner (MA5) | P2 | 33 | 473 | M1 | 58 | 35 |

Preparation of Cyan Toners (CA1) to (CA5)

Cyan toners (CA1) to (CA5) are prepared using the same preparation method as that of the black toner (KE1), except that the kind and amount of the crystalline resin particle dispersion, the amount of the amorphous resin particle dispersion (the amount in the raw material dispersion), and the kind and amount of the colorant dispersion are changed as shown in Table 5. All the volume average particle diameters of the cyan toners (CA1) to (CA5) are 7.5 μm.

TABLE 5

| | Crystalline Resin Particle Dispersion | | Amorphous Resin Particle Dispersion | Colorant Dispersion | | Dielectric Loss Factor |
|---|---|---|---|---|---|---|
| | Kind | Part (s) | Part (s) | Kind | Part (s) | ($\times 10^{-3}$) |
| Cyan Toner (CA1) | P1 | 31 | 444 | C1 | 50 | 10 |
| Cyan Toner (CA2) | P2 | 31 | 444 | C1 | 50 | 15 |
| Cyan Toner (CA3) | P3 | 31 | 444 | C1 | 50 | 25 |
| Cyan Toner (CA4) | P1 | 77 | 398 | C1 | 50 | 20 |
| Cyan Toner (CA5) | P2 | 33 | 473 | C1 | 58 | 35 |

Examples 1 to 10 and Comparative Examples 1 to 3

Toner sets according to respective examples are obtained by combining the brilliant toners (BR1) to (BR9), the black toners (KE1) to (KE6), and the color toners including the yellow toners (YE1) to (YE5), the magenta toners (MA1) to (MA5), and the cyan toners (CA1) to (CA5) according to Tables 6 to 8.

Preparation of Developer Set

Ferrite particles (average particle diameter: 50 μm): 100 parts

Toluene: 14 parts

Styrene-methyl methacrylate copolymer (copolymerization ratio: 15/85): 2 parts

Carbon black: 0.2 parts

The above-described components other than the ferrite particles are dispersed using a sand mill to prepare a dispersion. This dispersion and the ferrite particles are put into a vacuum degassing type kneader and are dried under reduced pressure while stirring the components. As a result, a carrier is obtained.

5 parts of the respective toners of the toner set according to each of the examples are mixed with each other with respect to 100 parts of the carrier to prepare a developer including the brilliant toner, a developer including the black toner, a developer including the yellow toner, a developer including the magenta toner, and a developer including the cyan toner. Then, a developer set according to each of the examples is prepared.

Evaluation

Inter-Tangent Line AB Distance of Brilliant Toner Particles

Regarding the brilliant toner of the toner set obtained in each of the examples, "inter-tangent line AB distance" is measured using the above-described method. The results are shown in Tables 6 to 8.

Here, "inter-tangent line AB distance" shown in Tables 6 to 8 refers to "when a projected image of each of the toner particles of the brilliant toner is observed, an average distance between a tangent line A of the toner particle and a tangent line B of the brilliant pigment at opposite end portions of the toner particle, the tangent line A being perpendicular to a long axis direction of the toner particle, and the tangent line B being parallel to the tangent line A and closest to the tangent line A" (refer to FIG. 1).

Dielectric Loss Factor of Each of Toners

The dielectric loss factor of each of the toners of the toner set according to each of the examples is measured using the above-described method. The results are shown in Tables 6 to 8.

(Evaluation of Occurrence of Density Unevenness)

As an image forming apparatus for forming an evaluation image, DOCUCENTRE COLOR 400 (manufactured by Fuji Xerox Co., Ltd.) is prepared, and developing units thereof are filled with the developers of the developer set according to each of the examples. As a recording medium, coated paper (OS coated paper W, manufactured by Fuji Xerox Co., Ltd.) is used.

First, using the image forming apparatus, 3,000 images (image density: 20%) including four colors of the black toner, the yellow toner, the magenta toner, and the cyan toner are continuously printed in a low-temperature and low-humidity (21° C., 10% RH) environment such that the applied amount of each of the toners is 4.0 g/m$^2$. During the continuous printing, the agitation of the developer including the brilliant toner is stopped.

Next, the agitation of the developer including the brilliant toner is started again, and then one image including five colors of the brilliant toner, the black toner, the yellow toner, the magenta toner, and the cyan toner is printed. Using this printed image (evaluation image 1), occurrence of density unevenness is evaluated by visual inspection.

Next, the internal environment of the image forming apparatus is adjusted to a high-temperature and high-humidity (28° C., 85% RH) environment. Next, 3,000 images (image density: 20%) including four colors of the black toner, the yellow toner, the magenta toner, and the cyan toner are continuously printed. During the continuous printing, the agitation of the developer including the brilliant toner is stopped.

Next, the agitation of the developer including the brilliant toner is started again, and then one image including five colors of the brilliant toner, the black toner, the yellow toner, the magenta toner, and the cyan toner is printed. Using this printed image (evaluation image 2), occurrence of density unevenness is evaluated by visual inspection.

Evaluation criteria are described below. The results are shown in Tables 6 to 8.

Evaluation Criteria

G0: density unevenness is not caused in the evaluation images 1 and 2

G1: density unevenness is slightly caused in the evaluation image 2, but there is no concern about the occurrence G2: density unevenness is caused in the evaluation image 2, and there is a little concern G3: density unevenness is caused in the evaluation image 2

G4: density unevenness is caused in the evaluation images 1 and 2

TABLE 6

| | | | | [Conditional Expression (2)] Difference between Dielectric Loss | Crystalline Polyester Resin Carbon Chain Length | |
|---|---|---|---|---|---|---|
| | | | Dielectric Loss Factor ($\times 10^{-3}$) | Factors of Brilliant Toner and Color Toner ($\times 10^{-3}$) | Dicarboxylic Acid Component | Diol Component |
| Example 1 | Toner Set (1) | Brilliant Toner (BR1) | 60 | — | 10 | 9 |
| | | Black Toner (KE2) | 20 | 40 | 10 | 6 |
| | | Yellow Toner (YE2) | 15 | 45 | 10 | 6 |
| | | Magenta Toner (MA2) | 15 | 45 | 10 | 6 |
| | | Cyan Toner (CA2) | 15 | 45 | 10 | 6 |
| Example 2 | Toner Set (2) | Brilliant Toner (BR3) | 65 | — | 10 | 9 |
| | | Black Toner (KE2) | 20 | 45 | 10 | 6 |
| | | Yellow Toner (YE2) | 15 | 50 | 10 | 6 |
| | | Magenta Toner (MA2) | 15 | 50 | 10 | 6 |
| | | Cyan Toner (CA2) | 15 | 50 | 10 | 6 |
| Example 3 | Toner Set (3) | Brilliant Toner (BR1) | 60 | — | 10 | 9 |
| | | Black Toner (KE3) | 30 | 30 | 8 | 6 |
| | | Yellow Toner (YE3) | 25 | 35 | 8 | 6 |
| | | Magenta Toner (MA3) | 25 | 35 | 8 | 6 |
| | | Cyan Toner (CA3) | 25 | 35 | 8 | 6 |
| Example 4 | Toner Set (4) | Brilliant Toner (BR2) | 68 | — | 10 | 6 |
| | | Black Toner (KE1) | 15 | 53 | 10 | 9 |
| | | Yellow Toner (YE1) | 10 | 58 | 10 | 9 |
| | | Magenta Toner (MA1) | 10 | 58 | 10 | 9 |
| | | Cyan Toner (CA1) | 10 | 58 | 10 | 9 |
| Example 5 | Toner Set (5) | Brilliant Toner (BR1) | 60 | — | 10 | 9 |
| | | Black Toner (KE4) | 25 | 35 | 10 | 9 |
| | | Yellow Toner (YE4) | 20 | 40 | 10 | 9 |
| | | Magenta Toner (MA4) | 20 | 40 | 10 | 9 |
| | | Cyan Toner (CA4) | 20 | 40 | 10 | 9 |

| | | | Crystalline Polyester Resin | | | Evaluation of |
|---|---|---|---|---|---|---|
| | | | Carbon Chain Length Total | Content (% by weight) | Inter-Tangent Line AB Distance (nm) | Ocurrence of Density Unevenness |
| Example 1 | Toner Set (1) | Brilliant Toner (BR1) | 19 | 5.4 | 450 | G1 |
| | | Black Toner (KE2) | 16 | 5.4 | — | G0 |
| | | Yellow Toner (YE2) | 16 | 5.4 | — | G0 |
| | | Magenta Toner (MA2) | 16 | 5.4 | — | G0 |
| | | Cyan Toner (CA2) | 16 | 5.4 | — | G0 |
| Example 2 | Toner Set (2) | Brilliant Toner (BR3) | 19 | 5.4 | 450 | G0 |
| | | Black Toner (KE2) | 16 | 5.4 | — | G0 |
| | | Yellow Toner (YE2) | 16 | 5.4 | — | G0 |

TABLE 6-continued

| | | | | | | |
|---|---|---|---|---|---|---|
| | | Magenta Toner (MA2) | 16 | 5.4 | — | G0 |
| | | Cyan Toner (CA2) | 16 | 5.4 | — | G0 |
| Example 3 | Toner Set (3) | Brilliant Toner (BR1) | 19 | 5.4 | 450 | G2 |
| | | Black Toner (KE3) | 14 | 5.4 | | G0 |
| | | Yellow Toner (YE3) | 14 | 5.4 | | G0 |
| | | Magenta Toner (MA3) | 14 | 5.4 | | G0 |
| | | Cyan Toner (CA3) | 14 | 5.4 | | G0 |
| Example 4 | Toner Set (4) | Brilliant Toner (BR2) | 16 | 5.4 | 450 | G2 |
| | | Black Toner (KE1) | 19 | 5.4 | — | G0 |
| | | Yellow Toner (YE1) | 19 | 5.4 | — | G0 |
| | | Magenta Toner (MA1) | 19 | 5.4 | — | G0 |
| | | Cyan Toner (CA1) | 19 | 5.4 | — | G0 |
| Example 5 | Toner Set (5) | Brilliant Toner (BR1) | 19 | 5.4 | 450 | G0 |
| | | Black Toner (KE4) | 19 | 13.4 | — | G0 |
| | | Yellow Toner (YE4) | 19 | 13.4 | — | G0 |
| | | Magenta Toner (MA4) | 19 | 13.4 | — | G0 |
| | | Cyan Toner (CA4) | 19 | 13.4 | — | G0 |

TABLE 7

| | | | | [Conditional Expression (2)] Difference between Dielectric Loss | Crystalline Polyester Resin Carbon Chain Length | |
|---|---|---|---|---|---|---|
| | | | Dielectric Loss Factor ($\times 10^{-3}$) | Factors of Brilliant Toner and Color Toner ($\times 10^{-3}$) | Dicarboxylic Acid Component | Diol Component |
| Example 6 | Toner Set (6) | Brilliant Toner (BR4) | 63 | — | 10 | 9 |
| | | Black Toner (KE1) | 15 | 48 | 10 | 9 |
| | | Yellow Toner (YE1) | 10 | 53 | 10 | 9 |
| | | Magenta Toner (MA1) | 10 | 53 | 10 | 9 |
| | | Cyan Toner (CA1) | 10 | 53 | 10 | 9 |
| Example 7 | Toner Set (7) | Brilliant Toner (BR5) | 90 | — | 10 | 9 |
| | | Black Toner (KE2) | 20 | 70 | 10 | 6 |
| | | Yellow Toner (YE2) | 15 | 75 | 10 | 6 |
| | | Magenta Toner (MA2) | 15 | 75 | 10 | 6 |
| | | Cyan Toner (CA2) | 15 | 75 | 10 | 6 |
| Example 8 | Toner Set (8) | Brilliant Toner (BR6) | 48 | — | 10 | 9 |
| | | Black Toner (KE2) | 20 | 28 | 10 | 6 |
| | | Yellow Toner (YE2) | 15 | 33 | 10 | 6 |
| | | Magenta Toner (MA2) | 15 | 33 | 10 | 6 |
| | | Cyan Toner (CA2) | 15 | 33 | 10 | 6 |
| Example 9 | Toner Set (9) | Brilliant Toner (BR1) | 60 | — | 10 | 9 |
| | | Black Toner (KE5) | 33 | 27 | 10 | 6 |
| | | Yellow Toner (YE2) | 15 | 45 | 10 | 6 |
| | | Magenta Toner (MA2) | 15 | 45 | 10 | 6 |
| | | Cyan Toner (CA2) | 15 | 45 | 10 | 6 |
| Example 10 | Toner Set (10) | Brilliant Toner (BR1) | 60 | — | 10 | 9 |
| | | Black Toner (KE6) | 35 | 25 | 10 | 6 |
| | | Yellow Toner (YE2) | 15 | 45 | 10 | 6 |
| | | Magenta Toner (MA2) | 15 | 45 | 10 | 6 |
| | | Cyan Toner (CA2) | 15 | 45 | 10 | 6 |

| | | | Crystalline Polyester Resin | | | Evaluation of |
|---|---|---|---|---|---|---|
| | | | Carbon Chain Length Total | Content (% by weight) | Inter-Tangent Line AB Distance (nm) | Ocurrence of Density Unevenness |
| Example 6 | Toner Set (6) | Brilliant Toner (BR4) | 19 | 13.4 | 450 | G2 |
| | | Black Toner (KE1) | 19 | 5.4 | — | G0 |
| | | Yellow Toner (YE1) | 19 | 5.4 | — | G0 |
| | | Magenta Toner (MA1) | 19 | 5.4 | — | G0 |
| | | Cyan Toner (CA1) | 19 | 5.4 | — | G0 |
| Example 7 | Toner Set (7) | Brilliant Toner (BR5) | 19 | 5.4 | 35 | G2 |
| | | Black Toner (KE2) | 16 | 5.4 | — | G0 |
| | | Yellow Toner (YE2) | 16 | 5.4 | — | G0 |
| | | Magenta Toner (MA2) | 16 | 5.4 | — | G0 |
| | | Cyan Toner (CA2) | 16 | 5.4 | — | G0 |
| Example 8 | Toner Set (8) | Brilliant Toner (BR6) | 19 | 5.4 | 950 | G2 |
| | | Black Toner (KE2) | 16 | 5.4 | — | G0 |
| | | Yellow Toner (YE2) | 16 | 5.4 | — | G0 |
| | | Magenta Toner (MA2) | 16 | 5.4 | — | G0 |
| | | Cyan Toner (CA2) | 16 | 5.4 | — | G0 |
| Example 9 | Toner Set (9) | Brilliant Toner (BR1) | 19 | 5.4 | 450 | G0 |
| | | Black Toner (KE5) | 16 | 5.4 | — | G0 |
| | | Yellow Toner (YE2) | 16 | 5.4 | — | G0 |
| | | Magenta Toner (MA2) | 16 | 5.4 | — | G0 |
| | | Cyan Toner (CA2) | 16 | 5.4 | — | G0 |

TABLE 7-continued

| | | | | | | |
|---|---|---|---|---|---|---|
| Example 10 | Toner Set (10) | Brilliant Toner (BR1) | 19 | 5.4 | 450 | G0 |
| | | Black Toner (KE6) | 16 | 5.4 | — | G0 |
| | | Yellow Toner (YE2) | 16 | 5.4 | — | G0 |
| | | Magenta Toner (MA2) | 16 | 5.4 | — | G0 |
| | | Cyan Toner (CA2) | 16 | 5.4 | — | G0 |

TABLE 8

| | | | | [Conditional Expression (2)] Difference between Dielectric Loss | Crystalline Polyester Resin Carbon Chain Length | |
|---|---|---|---|---|---|---|
| | | | Dielectric Loss Factor ($\times 10^{-3}$) | Factors of Brilliant Toner and Color Toner ($\times 10^{-3}$) | Dicarboxylic Acid Component | Diol Component |
| Comparative Example 1 | Toner Set (11) | Brilliant Toner (BR7) | 35 | — | 10 | 9 |
| | | Black Toner (KE2) | 20 | 15 | 10 | 6 |
| | | Yellow Toner (YE2) | 15 | 20 | 10 | 6 |
| | | Magenta Toner (MA2) | 15 | 20 | 10 | 6 |
| | | Cyan Toner (CA2) | 15 | 20 | 10 | 6 |
| Comparative Example 2 | Toner Set (12) | Brilliant Toner (BR8) | 120 | — | 10 | 9 |
| | | Black Toner (KE2) | 20 | 100 | 10 | 6 |
| | | Yellow Toner (YE2) | 15 | 105 | 10 | 6 |
| | | Magenta Toner (MA2) | 15 | 105 | 10 | 6 |
| | | Cyan Toner (CA2) | 15 | 105 | 10 | 6 |
| Comparative Example 3 | Toner Set (13) | Brilliant Toner (BR9) | 30 | — | 10 | 9 |
| | | Black Toner (KE5) | 33 | −3 | 10 | 6 |
| | | Yellow Toner (YE5) | 35 | −5 | 10 | 6 |
| | | Magenta Toner (MA5) | 35 | −5 | 10 | 6 |
| | | Cyan Toner (CA5) | 35 | −5 | 10 | 6 |

| | | | Crystalline Polyester Resin | | | Evaluation of |
|---|---|---|---|---|---|---|
| | | | Carbon Chain Length Total | Content (% by weight) | Inter-Tangent Line AB Distance (nm) | Ocurrence of Density Unevenness |
| Comparative Example 1 | Toner Set (11) | Brilliant Toner (BR7) | 19 | 5.4 | 1050 | G4 |
| | | Black Toner (KE2) | 16 | 5.4 | — | G0 |
| | | Yellow Toner (YE2) | 16 | 5.4 | — | G0 |
| | | Magenta Toner (MA2) | 16 | 5.4 | — | G0 |
| | | Cyan Toner (CA2) | 16 | 5.4 | — | G0 |
| Comparative Example 2 | Toner Set (12) | Brilliant Toner (BR8) | 19 | 5.4 | 20 | G4 |
| | | Black Toner (KE2) | 16 | 5.4 | — | G0 |
| | | Yellow Toner (YE2) | 16 | 5.4 | — | G0 |
| | | Magenta Toner (MA2) | 16 | 5.4 | — | G0 |
| | | Cyan Toner (CA2) | 16 | 5.4 | — | G0 |
| Comparative Example 3 | Toner Set (13) | Brilliant Toner (BR9) | 19 | 5.4 | 1100 | G4 |
| | | Black Toner (KE5) | 16 | 5.4 | — | G0 |
| | | Yellow Toner (YE5) | 16 | 5.4 | — | G0 |
| | | Magenta Toner (MA5) | 16 | 5.4 | — | G0 |
| | | Cyan Toner (CA5) | 16 | 5.4 | — | G0 |

Description of Tables 6 to 8

"Difference between Dielectric Loss Factors of Brilliant Toner and Color Toner" refers to "(Dielectric Loss Factor of Brilliant Toner)−(Dielectric Loss Factor of Color Toner)" shown in the conditional expression (2). "Content" refers to "the content of the crystalline resin of each of the toners with respect to the toner particles of the toner".

It may be seen that, in Examples, even in any of a low-temperature and low-humidity environment or a high-temperature and high-humidity environment, density unevenness, which may be caused when an image is formed using the brilliant toner after continuously forming images only using the black toner and the color toners (the yellow toner, the magenta toner, and the cyan toner), is prevented as compared to Comparative Examples.

It may be seen that, in Examples 1 to 10 in which the inter-tangent line AB distance is 30 nm or more and less than 1,000 nm, density unevenness, which may be caused when an image is formed using the brilliant toner after continuously forming images only using the black toner and the color toners, is prevented as compared to Comparative Examples 1 to 3 in which the inter-tangent line AB distance is less than 30 nm or 1,000 nm or more.

It may be seen from a comparison between Examples 1 to 3 and 7 to 10 and Example 4 that, in Examples 1 to 3 and 7 to 10 in which the carbon chain length of the crystalline polyester resin of the brilliant toner is longer than the carbon chain length of the crystalline polyester resin of the black toner and the carbon chain length of the crystalline polyester resin of the color toner, density unevenness, which may be caused when an image is formed using the brilliant toner after continuously forming images only using the black toner and the color toners, is likely to be prevented.

It may be seen from a comparison between Example 5 and Example 6 that, in Example 5 in which the content of the crystalline polyester resin of the brilliant toner with respect to the toner particles of the brilliant toner is lower than the content of the crystalline polyester resin of the black toner with respect to the toner particles of the black toner and the content of the crystalline polyester resin of the color toner with respect to the toner particles of the color toner, density unevenness, which may be caused when an image is formed using the brilliant toner after continuously forming images only using the black toner and the color toners, is prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner set comprising:

a brilliant toner including toner particles that include a brilliant pigment and a first binder resin;

a black toner including toner particles that include a second binder resin; and a color toner, except a black toner, including toner particles that include a third binder resin, wherein the brilliant toner, the black toner, and the color toner satisfy the following expressions (1) and (2):

Dielectric loss factor of the brilliant toner>Dielectric loss factor of the black toner>Dielectric loss factor of the color toner Expression (1), and $25\times10^{-3}\leq$(Dielectric loss factor of the brilliant toner)−(Dielectric loss factor of the color toner) $\leq95\times10^{-3}$ Expression (2), wherein the first binder resin includes a first crystalline polyester resin, the second binder resin includes a second crystalline polyester resin, and the third binder resin includes a third crystalline polyester resin, and a carbon chain length of the first crystalline polyester resin of the brilliant toner is longer than a carbon chain length of the second crystalline polyester resin of the black toner and a carbon chain length of the third crystalline polyester resin of the color toner.

2. The electrostatic charge image developing toner set according to claim 1, wherein a difference between the carbon chain length of the first crystalline polyester resin and the carbon chain length of the second crystalline polyester resin is from 1 to 8 and a difference between the carbon chain length of the first crystalline polyester resin and the carbon chain length of the third crystalline polyester resin is from 1 to 8.

3. The electrostatic charge image developing toner set according to claim 1, wherein a difference between the carbon chain length of the first crystalline polyester resin and the carbon chain length of the second crystalline polyester resin is from 2 to 6 and a difference between the carbon chain length of the first crystalline polyester resin and the carbon chain length of the third crystalline polyester resin is from 2 to 6.

4. The electrostatic charge image developing toner set according to claim 1, wherein when a projected image of each of the toner particles of the brilliant toner is observed, an average distance between a tangent line A of the toner particle and a tangent line B of the brilliant pigment at opposite end portions of the toner particle is 30 nm or more and less than 1,000 nm, the tangent line A being perpendicular to a long axis direction of the toner particle, and the tangent line B being parallel to the tangent line A and closest to the tangent line A.

5. An electrostatic charge image developing toner set comprising:

a brilliant toner including toner particles that include a brilliant pigment and a first binder resin;

a black toner including toner particles that include a second binder resin; and a color toner, except a black toner, including toner particles that include a third binder resin, wherein the brilliant toner, the black toner, and the color toner satisfy the following expressions (1) and (2):

Dielectric loss factor of the brilliant toner>Dielectric loss factor of the black toner>Dielectric loss factor of the color toner Expression (1), and $25\times10^{-3}\leq$(Dielectric loss factor of the brilliant toner)−(Dielectric loss factor of the color toner)$\leq95\times10^{-3}$ Expression (2), wherein the first binder resin includes a first crystalline polyester resin, the second binder resin includes a second crystalline polyester resin, and the third binder resin includes a third crystalline polyester resin, and a content of the first crystalline polyester resin with respect to the toner particles of the brilliant toner is lower than a content of the second crystalline polyester resin with respect to the toner particles of the black toner and a content of the third crystalline polyester resin with respect to the toner particles of the color toner.

6. The electrostatic charge image developing toner set according to claim 5, wherein a difference between the content of the first crystalline polyester resin with respect to the toner particles of the brilliant toner and the content of the second crystalline polyester resin with respect to the toner particles of the black toner is from 2 to 10 and a difference between the content of the first crystalline polyester resin with respect to the toner particles of the brilliant toner and the content of the third crystalline polyester resin with respect to the toner particles of the color toner is from 2 to 10.

7. The electrostatic charge image developing toner set according to claim 1, wherein the brilliant toner further includes an organic pigment.

8. An electrostatic charge image developer set comprising:

a first electrostatic charge image developer that includes a carrier and the brilliant toner of the electrostatic charge image developing toner set according to claim 1;

a second electrostatic charge image developer that includes a carrier and the black toner of the electrostatic charge image developing toner set according to claim 1; and a third electrostatic charge image developer that includes a carrier and the color toner of the electrostatic charge image developing toner set according to claim 1.

9. A toner cartridge set comprising:

a first toner cartridge that includes a toner container containing the brilliant toner of the electrostatic charge image developing toner set according to claim 1;

a second toner cartridge that includes a toner container containing the black toner of the electrostatic charge image developing toner set according to claim 1; and a third toner cartridge that includes a toner container containing the color toner of the electrostatic charge image developing toner set according to claim 1, wherein the toner cartridge set is detachable from an image forming apparatus.

* * * * *